US007939578B2

(12) United States Patent
Wright et al.

(10) Patent No.: US 7,939,578 B2
(45) Date of Patent: May 10, 2011

(54) POLYMERIC FIBERS AND METHODS OF MAKING

(75) Inventors: Robin E. Wright, Inver Grove Heights, MN (US); Mahfuza B. Ali, Mendota Heights, MN (US); Jessica M. Buchholz, Saint Paul, MN (US); Louis C. Haddad, Mendota Heights, MN (US); Linda K. M. Olson, Saint Paul, MN (US); Matthew T. Scholz, Woodbury, MN (US); Narina Y. Stepanova, Inver Grove Heights, MN (US); Michael J. Svarovsky, Eagan, MN (US); Richard L. Walter, Saint Paul, MN (US); Caroline M. Ylitalo, Stillwater, MN (US); Diane R. Wolk, Woodbury, MN (US); Yifan Zhang, Woodbury, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 800 days.

(21) Appl. No.: 11/847,397

(22) Filed: Aug. 30, 2007

(65) Prior Publication Data

US 2008/0207794 A1 Aug. 28, 2008

Related U.S. Application Data

(60) Provisional application No. 60/891,260, filed on Feb. 23, 2007, provisional application No. 60/946,745, filed on Jun. 28, 2007.

(51) Int. Cl.

| | |
|---|---|
| ***C08F 2/50*** | (2006.01) |
| ***C08J 3/28*** | (2006.01) |
| ***B32B 27/16*** | (2006.01) |
| ***B32B 37/24*** | (2006.01) |
| ***B32B 27/18*** | (2006.01) |
| ***B32B 27/30*** | (2006.01) |

(52) U.S. Cl. ..... 522/181; 522/71; 522/74; 522/84; 522/104; 522/150; 522/153; 522/178; 522/182; 524/800; 524/804; 524/832; 524/845; 428/357; 428/364; 428/392; 428/394; 428/395; 252/182.11; 252/182.12; 252/182.13; 252/182.18; 252/182.23; 252/182.27; 523/300

(58) Field of Classification Search ..... 522/71, 522/74, 84, 104, 150, 153, 178, 181, 182; 524/800, 804, 832, 845; 428/357, 364, 392, 428/394, 395; 427/496, 457, 508; 252/182.11, 252/182.12, 182.13, 182.18, 182.23, 182.27; 523/300

See application file for complete search history.

(56) References Cited

U.S. PATENT DOCUMENTS

| | | | |
|---|---|---|---|
| 3,975,350 | A | 8/1976 | Hudgin et al. |
| 4,157,418 | A | 6/1979 | Heilmann |
| 4,231,370 | A | 11/1980 | Mroz et al. |
| 4,351,992 | A | 9/1982 | Crouch |
| 4,444,961 | A | 4/1984 | Timm |
| 4,542,176 | A | 9/1985 | Graham |
| 4,597,975 | A | 7/1986 | Woodward et al. |
| 4,646,730 | A | 3/1987 | Schonfeld et al. |
| 4,814,131 | A | 3/1989 | Atlas |
| 4,873,299 | A | 10/1989 | Nowakowsky et al. |
| 4,929,400 | A | 5/1990 | Rembaum et al. |
| 4,988,568 | A | 1/1991 | Hasegawa et al. |
| 5,059,664 | A | 10/1991 | Yada et al. |
| 5,126,381 | A | 6/1992 | Liscomb |
| 5,435,816 | A | 7/1995 | Spurgeon et al. |
| 5,437,932 | A | 8/1995 | Ali et al. |
| 5,447,727 | A | 9/1995 | Graham |
| 5,506,279 | A | 4/1996 | Babu et al. |
| 5,506,324 | A | 4/1996 | Gartner et al. |
| 5,514,379 | A | 5/1996 | Weissleder et al. |
| 5,667,541 | A | 9/1997 | Klun et al. |
| 5,670,557 | A | 9/1997 | Dietz et al. |
| 5,674,521 | A | 10/1997 | Gehrke et al. |
| 5,674,561 | A | 10/1997 | Dietz et al. |
| 5,690,705 | A | 11/1997 | Holmes et al. |
| 5,714,259 | A | 2/1998 | Holmes et al. |
| 5,779,632 | A | 7/1998 | Dietz et al. |
| 5,954,869 | A | 9/1999 | Elfersy et al. |
| 6,066,325 | A | 5/2000 | Wallace et al. |
| 6,297,424 | B1 | 10/2001 | Olson et al. |
| 6,376,590 | B2 | 4/2002 | Kolb et al. |
| 6,467,897 | B1 | 10/2002 | Wu et al. |
| 6,471,975 | B1 | 10/2002 | Banovetz et al. |
| 6,559,351 | B1 | 5/2003 | Eakin |
| 6,669,981 | B2 | 12/2003 | Parsons et al. |
| 6,709,716 | B2 | 3/2004 | Uy et al. |

(Continued)

FOREIGN PATENT DOCUMENTS

| | | |
|---|---|---|
| DE | 10114496 | 9/2002 |

(Continued)

OTHER PUBLICATIONS

Andreopoulos, F.M., et al., "Photoscissable hydrogel synthesis via rapid photopolymerization of novel PEG-based polymers in the absence of photoinitiators", *J. Am. Chem. Soc.*, vol. 118, No. 26, pp. 6235-6240 (Jul. 3, 1996).

Andreopoulos, F.M. et al., "Light-indusing tailoring of PEG-hydrogel properties", *Biomaterials*, vol. 19, No. 15, pp. 1343-1352, (Aug. 31, 1998).

Lin-Gibson, S., et al., "Synthesis and characterization of poly(ethylene glycol) dimethacrylate hydrogels", *Macromolecular Symposia*, vol. 227, pp. 243-254, (Dec. 31, 2005).

(Continued)

*Primary Examiner* — Sanza L McClendon

(74) *Attorney, Agent, or Firm* — Jean A. Lown

(57) ABSTRACT

Polymeric fibers and methods of making the polymeric fibers are described. The polymeric fibers are crosslinked hydrogels or dried hydrogels that are prepared from a precursor composition that contains polymerizable material having an average number of ethylenically unsaturated groups per monomer molecule greater than 1.0. The polymeric fibers can contain an optional active agent.

24 Claims, 3 Drawing Sheets

U.S. PATENT DOCUMENTS

| | | | |
|---|---|---|---|
| 6,772,708 | B2 | 8/2004 | Klofta et al. |
| 6,800,278 | B1 | 10/2004 | Perrault et al. |
| 6,808,738 | B2 | 10/2004 | DiTizio et al. |
| 6,852,255 | B2 | 2/2005 | Yang et al. |
| 6,905,698 | B1 | 6/2005 | Aldcroft et al. |
| 6,967,261 | B1 | 11/2005 | Soerens et al. |
| 7,005,143 | B2 | 2/2006 | Abuelyaman et al. |
| 7,074,063 | B1 | 7/2006 | Bailey et al. |
| 2004/0086479 | A1 | 5/2004 | Grinstaff et al. |
| 2004/0157971 | A1 | 8/2004 | Kim |
| 2005/0124724 | A1 | 6/2005 | Burton et al. |
| 2005/0215752 | A1 | 9/2005 | Popp et al. |
| 2005/0287191 | A1 | 12/2005 | Munro et al. |
| 2006/0051384 | A1 | 3/2006 | Scholz et al. |
| 2006/0051385 | A1 | 3/2006 | Scholz |
| 2006/0052452 | A1 | 3/2006 | Scholz |
| 2006/0062854 | A1 | 3/2006 | Chandra et al. |
| 2006/0127435 | A1 | 6/2006 | Van Voris et al. |
| 2006/0148950 | A1 | 7/2006 | Davidson et al. |
| 2006/0155057 | A1 | 7/2006 | Hermeling et al. |
| 2006/0212011 | A1 | 9/2006 | Popp et al. |
| 2006/0235141 | A1 | 10/2006 | Riegel et al. |

FOREIGN PATENT DOCUMENTS

| | | |
|---|---|---|
| EP | 0 201 214 | 11/1986 |
| EP | 0 233 667 | 8/1987 |
| EP | 0 374 807 | 6/1990 |
| EP | 0 679 333 | 11/1995 |
| EP | 1 371 668 | 12/2003 |
| JP | 54074886 | 6/1979 |
| JP | 6248107 | 3/1987 |
| JP | 7133355 | 9/1994 |
| JP | 2002322203 | 8/2002 |
| JP | 2003034703 | 2/2003 |
| KR | 2001016592 | 3/2001 |
| KR | 2003-45730 | 6/2003 |
| WO | WO 93/21237 | 10/1993 |
| WO | WO 99/56542 | 11/1999 |
| WO | WO 01/41818 | 6/2001 |
| WO | WO 01/56625 | 8/2001 |
| WO | WO 03/061538 | 7/2003 |
| WO | WO 2004/028255 | 4/2004 |
| WO | WO 2004/105687 | 12/2004 |
| WO | WO 2005/062018 | 7/2005 |
| WO | WO 2006/002641 | 1/2006 |
| WO | WO 2006/079631 | 8/2006 |

OTHER PUBLICATIONS

Mellott, M.B., et al., "Release of protein from highly cross-linked hydrogels of poly(ethylene glycol) diacrylate fabricated by UV polymerization", *Biomaterials*, vol. 22, pp. 929-941 (2001).

Russell, R.J., et al., "Poly(ethylene glycol) hydrogel-encapsulated fluorophore-enzyme conjugates for direct detection of organophosphorus neurotoxins", *Analytical Chemistry*, vol. 71, No. 21, pp. 4909-4912 (Nov. 1, 1999).

Sugimoto, M., et al., "Applicability of UV Curable Urethane Acrylate Coating at High Drawing Speed", *International Wire & Cable Symposium Proceedings*, pp. 418-425 (1997).

U.S. Appl. No. 11/759,283, filed Jun. 7, 2007, entitled "Polymeric Beads and Methods of Making Polymeric Beads".

Form 1507 EP Search Report 61756EP004.

POLYMERIC FIBERS AND METHODS OF MAKING

RELATED APPLICATIONS

This application claims priority to U.S. Provisional Application 60/891,260 filed on Feb. 23, 2007 and to U.S. Provisional Application 60/946,745 filed on Jun. 28, 2007, both disclosures incorporated herein by reference.

FIELD OF THE DISCLOSURE

The present disclosure is directed to polymeric fibers and methods of making polymeric fibers.

BACKGROUND

There are numerous commercial uses for polymeric fibers such as, for example, biological uses, medical uses, and industrial uses. Applications of polymeric fibers continue to increase and expand in scope. There is a continuing need for polymeric fibers with unique physical properties and added versatility. Various processes for making polymeric fibers are known.

There is always a desire for improvements in polymeric fibers and processes for making them. In particular, there is a desire for new fibers suitable for medical applications.

SUMMARY

Polymeric fibers and methods of making the polymeric fibers are described. The polymeric fibers contain a crosslinked hydrogel that optionally can be dried. The polymeric fibers, in some embodiments, can contain an active agent. That is, the polymeric fibers can function as a carrier for various active agents.

In a first aspect, a method of making a polymeric fiber is provided. The method includes forming a precursor composition containing (a) at least 5 weight percent polar solvent based on a total weight of the precursor composition and (b) polymerizable material that is miscible with the polar solvent. The polymerizable material has an average number of ethylenically unsaturated groups per monomer molecule greater than 1.0. The method further includes forming a stream of the precursor composition and exposing the stream to radiation for a time sufficient to at least partially polymerize the polymerizable material. A first swollen polymeric fiber is formed that has an aspect ratio greater than 3:1.

In a second aspect, another method of making a polymeric fiber is provided. The method includes forming a precursor composition containing (a) 5 weight percent to 85 weight percent polar solvent based on a total weight of the precursor composition and (b) 15 weight percent to 95 weight percent polymerizable material based on the total weight of the precursor composition, wherein the polymerizable material is miscible with the polar solvent. The polymerizable material includes a poly(alkylene oxide (meth)acrylate) having at least 2 (meth)acryloyl groups and having at least 5 alkylene oxide units. The method further includes forming a stream of the precursor composition and exposing the stream to radiation for a time sufficient to at least partially polymerize the polymerizable material. A first swollen polymeric fiber is formed that has an aspect ratio greater than 3:1.

In a third aspect, an article is provided that includes a polymeric fiber having an aspect ratio greater than 3:1. The polymeric fiber is a free-radical polymerization reaction product of a precursor composition that contains (a) 5 weight percent to 85 weight percent polar solvent based on a total weight of the precursor composition and (b) 15 weight percent to 95 weight percent polymerizable material based on the total weight of the precursor composition, wherein the polymerizable material is miscible with the polar solvent. The polymerizable material includes a poly(alkylene oxide (meth)acrylate) having at least 2 (meth)acryloyl groups and having at least 5 alkylene oxide units.

In a fourth aspect, an article is provided that includes a polymeric fiber having an aspect ratio greater than 3:1 and that contains an active agent. The polymeric fiber includes (a) a reaction product of a precursor composition that contains polymerizable material that includes a poly(alkylene oxide (meth)acrylate) having at least 2 (meth)acryloyl groups and having at least 5 alkylene oxide units and (b) an active agent.

The above summary of the present invention is not intended to describe each disclosed embodiment or every implementation of the present invention. The Detailed Description and Examples that follow more particularly exemplify these embodiments.

DETAILED DESCRIPTION

Polymeric fibers and methods of making the polymeric fibers are described. The polymeric fibers are crosslinked hydrogels or dried hydrogels. As used herein, the term "hydrogel" refers to a polymeric material that is hydrophilic and that is either swollen or capable of being swollen with a polar solvent. The polymeric material typically swells but does not dissolve when contacted with the polar solvent. That is, the hydrogel is insoluble in the polar solvent. The swollen polymeric fibers can be dried to remove at least some of the polar solvent. In some embodiments, the polymeric fibers also contain an active agent.

The polymeric fibers can be formed from a stream of a precursor composition. As used herein, the term "precursor composition" refers to the reactant mixture that is subjected to radiation to form the polymeric fibers. That is, the precursor composition describes the reaction mixture prior to polymerization. The precursor composition contains a polar solvent and polymerizable material that is miscible with the polar solvent. The precursor composition can also include other optional additives such as processing agents, active agents, or mixtures thereof. The stream of the precursor composition is often surrounded by a gaseous phase. Upon exposure to radiation, the polymerizable material within the precursor composition undergoes a free-radical polymerization reaction and polymeric fibers are formed. The reaction product is a hydrogel that contains polymerized material, the polar solvent, and any optional additives. The polar solvent swells the polymeric material and is part of the hydrogel rather than being a separate phase.

As used herein, the terms "fiber" and "polymeric fiber" are used interchangeably. The polymeric fibers can have any length but are often in the range of a 1 millimeter to 100 meters. The polymeric fiber has an aspect ratio (i.e., length to diameter ratio) that is greater than 3:1. For example, the aspect ratio can be greater than 4:1, greater than 5:1, greater than 6:1, greater than 8:1, or greater than 10:1. The aspect ratio refers to the ratio of the longest dimension of the polymeric fiber to the dimension orthogonal to the longest dimension. The cross-sectional shape, taken along the diameter, can be any shape. In some embodiments, the cross-sectional shape is circular or elliptical. As used herein, the term "circular" refers to a shape that is circular or nearly circular. Likewise, the term "elliptical" refers to a shape that is elliptical or nearly elliptical.

Figure 1:
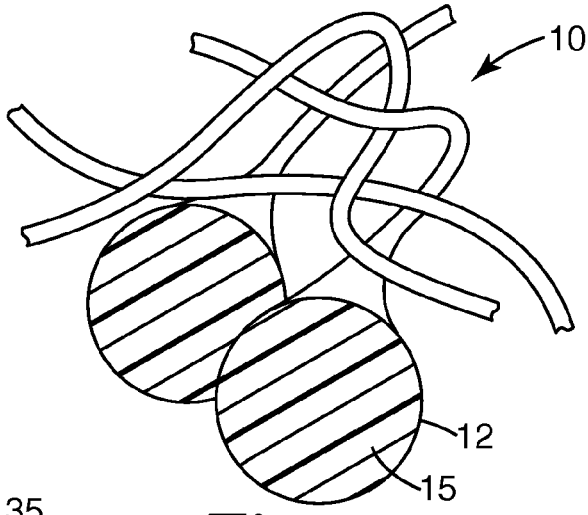
FIG. 1 is a schematic illustration of a plurality of exemplary polymeric fibers, with two of the polymeric fibers shown in cross-section.

FIG. 1 is a schematic representation of multiple polymeric fibers. Each polymeric fiber 10 has an outer surface 12 and an inner composition 15. The polymeric fiber 10 is homogeneous, without any discernible interface between the outer surface 12 and the inner composition 15, even when viewed under a microscope such as a scanning electron microscope or optical microscope. As prepared, the polymeric fiber is swollen with the polar solvent included in the precursor composition. When dried to remove at least a portion of the polar solvent, the dried polymeric fiber often remains homogeneous and does not contain internal pores or channels such as macroscopic (i.e., greater than 100 nm) pores or channels. This homogeneity of the polymeric fiber and the dried polymeric fiber refers to the polymeric matrix containing the polymerized material and any polar solvent that may be present. If an active agent is present, the active agent may or may not be distributed homogeneously throughout the polymeric fiber. Further, the active agent may be present in a separate phase from the polymeric matrix.

Figure 4:
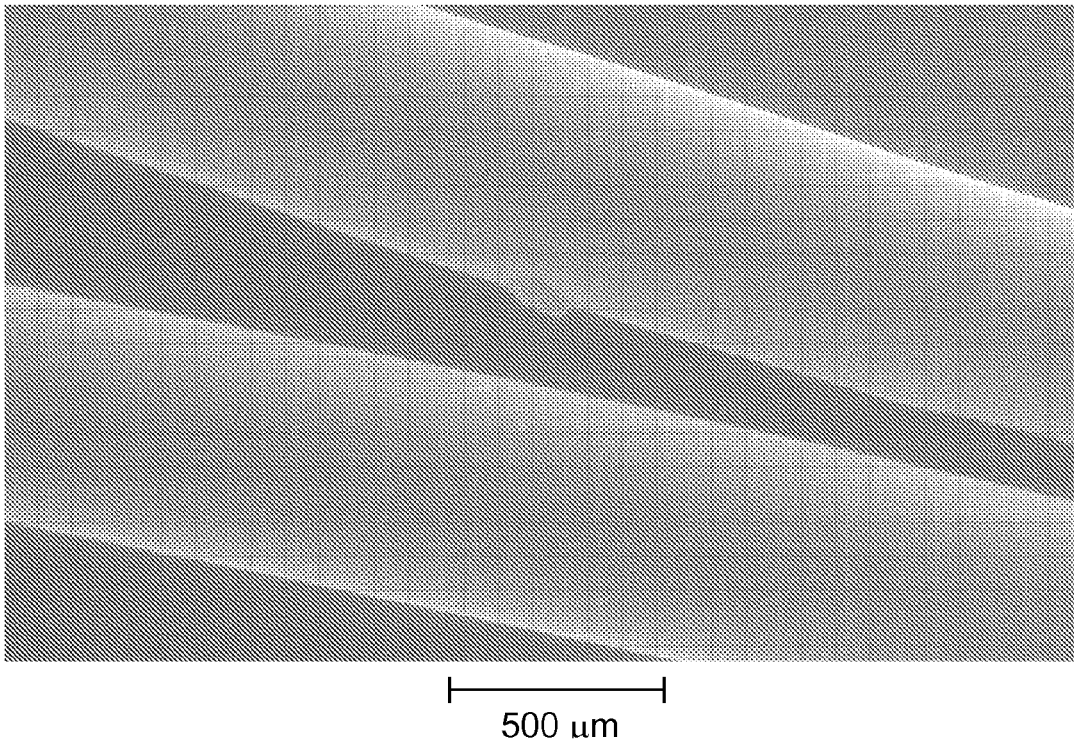
FIG. 4 is an exemplary environmental scanning electron micrograph of a two swollen polymeric fibers having a magnification of 50 times.

Generally, the polymeric fibers (particularly those without an active agent) have no discernible porosity or voids when viewed under a microscope. For example, there are no discernible pores when the polymeric fibers are viewed using environmental scanning electron microscopy with magnification up to 50 times as shown in FIG. 4 for two exemplary swollen polymeric fibers. Often no discernible pores can be seen when the polymeric fibers are viewed using field emission scanning electron microscopy with a magnification up to 100 times, up to 200 times, up to 500 times, up to 1,000 times, up to 5,000 times, up to 10,000 times, up to 20,000 times, or up to 50,000 times.

The polymeric fibers are formed from a precursor composition that contains (i) at least 5 weight percent polar solvent based on a total weight of the precursor composition and (ii) a polymerizable material that is miscible with the polar solvent. The polymerizable material contains at least one monomer that is capable of free-radical polymerization and that has an average number of ethylenically unsaturated groups per monomer molecule greater than 1.0. In some embodiments, other optional additives such as processing agents, active agents, or mixtures thereof can be present in the precursor composition. If present, these optional additives can be either dissolved or dispersed in the precursor composition.

As used herein, the term "polar solvent" refers to water, a water-miscible organic solvent, or a mixture thereof. Although the polar solvent is not reactive in the precursor composition (i.e., the polar solvent is not a monomer), the polar solvent typically swells the resulting polymeric fiber. That is, the polymerizable material is polymerized in the presence of the polar solvent so the resulting polymeric fiber is swollen with the polar solvent. Swollen polymeric fibers contain at least some of the polar solvent included in the precursor composition. Often, the swollen polymeric fibers contain most or all of the polar solvent included in the precursor composition.

Any water used in the precursor composition can be tap water, well water, deionized water, spring water, distilled water, sterile water, or any other suitable type of water. A water-miscible organic solvent refers to an organic solvent that is typically capable of hydrogen bonding and that forms a single phase solution when mixed with water. For example, a single phase solution exists when the water-miscible organic solvent is mixed with water in an amount equal to at least 10 weight percent, at least 20 weight percent, at least 30 weight percent, at least 40 weight percent, or at least 50 weight percent based on a total weight of the solution. While ideally a liquid at room temperature, the water-miscible organic solvent may also be a solid having a melting temperature below about 50° C. Suitable water-miscible organic solvents, which often contain hydroxyl or oxy groups, include alcohols, polyols having a weight average molecular weight no greater than about 300 g/mole, ethers, and polyethers having a weight average molecular weight no greater than about 300 g/mole. Exemplary water-miscible organic solvents include, but are not limited to, methanol, ethanol, isopropanol, n-propanol, ethylene glycol, triethylene glycol, glycerol, polyethylene glycol, propylene glycol, dipropylene glycol, polypropylene glycol, random and block copolymers of ethylene oxide and propylene oxide, dimethoxytetraglycol, butoxytriglycol, trimethylene glycol trimethyl ether, ethylene glycol dimethyl ether, ethylene glycol monobutyl ether, ethylene glycol monoethyl ether, and mixtures thereof.

The polar solvent is often present in an amount equal to at least 5 weight percent based on a total weight of the precursor composition. In some exemplary precursor compositions, the polar solvent is present in an amount equal to at least 10 weight percent, at least 15 weight percent, at least 20 weight percent, at least 25 weight percent, at least 30 weight percent, at least 40 weight percent, or at least 50 weight percent based on the total weight of the precursor composition. The polar solvent in the precursor composition can be present in an amount up to 85 weight percent, up to 80 weight percent, up to 75 weight percent, up to 70 weight percent, or up to 60 weight percent based on the total weight of the precursor composition. In some precursor compositions, the polar solvent is present in an amount in the range of 5 to 85 weight percent, 10 to 85 weight percent, 5 to 80 weight percent, 10 to 80 weight percent, 20 to 80 weight percent, 30 to 80 weight percent, or 40 to 80 weight percent based on the total weight of the precursor composition.

The polymerizable material is miscible with the polar solvent and does not phase separate from the polar solvent. As used herein with reference to the polymerizable material, the term "miscible" means that the polymerizable material is predominately soluble in the polar solvent or compatible with the polar solvent. However, there can be a small amount of the polymerizable material that does not dissolve in the polar solvent. For example, the polymerizable material may have an impurity that does not dissolve in the polar solvent. Generally, at least 95 weight percent, at least 97 weight percent, at least 98 weight percent, at least 99 weight percent, at least 99.5 weight percent, at least 99.8 weight percent, or at least 99.9 weight percent of the polymerizable material is soluble in the polar solvent.

As used herein, the term "polymerizable material" can refer to a monomer or to a mixture of monomers. The terms "monomer" and "monomer molecule" are used interchangeably to refer to a compound that contains at least one polymerizable group capable of free-radical polymerization. The polymerizable group is usually an ethylenically unsaturated group.

In some embodiments, the polymerizable material includes a monomer of a single chemical structure. In other embodiments, the polymerizable material includes a plurality of different monomers (i.e., there is a mixture of monomers having different chemical structures). Whether the polymerizable material includes one monomer or a mixture of monomers, the polymerizable material has an average number of polymerizable groups (e.g., ethylenically unsaturated groups) per monomer molecule greater than 1.0. The polymerizable material can include, for example, a single type of monomer that has two or more polymerizable groups. Alternatively, the polymerizable material can include a plurality of different types of monomers such that the average number of polymerizable groups per monomer molecule is greater than 1.0. In some embodiments, the average number of polymerizable groups per monomer molecule is equal to at least 1.1, at least 1.2, at least 1.3, at least 1.4, at least 1.5, at least 1.6, at least 1.7, at least 1.8, at least 1.9, at least 2.0, at least 2.1, at least 2.2, at least 2.3, at least 2.4, at least 2.5, at least 2.6, at least 2.7, at least 2.8, at least 2.9, or at least 3.0.

The average number of polymerizable groups per molecule is determined by determining the relative molar concentration of each monomer molecule and its functionality (number of polymerizable groups) and determining the number average functionality. For example, a polymerizable material that contains X mole percent of a first monomer having n polymerizable groups and (100−X) mole percent of a second monomer having m polymerizable groups has an average number of polymerizable groups per monomer molecule equal to $[n(X)+m(100-X)]/100$. In another example, a polymerizable material that contains X mole percent of a first monomer having n polymerizable groups, Y mole percent of a second monomer having m polymerizable groups, and (100−X−Y) mole percent of a third monomer having q polymerizable groups has an average number of polymerizable groups per molecule equal to $[n(X)+m(Y)+q(100-X-Y)]/100$.

The polymerizable material includes at least one monomer having two or more polymerizable groups. Often, the polymerizable material typically contains at least 5 weight percent of a monomer having two or more polymerizable groups. For example, the polymerizable material can contain at least 10 weight percent, at least 20 weight percent, at least 30 weight percent, at least 40 weight percent, at least 50 weight percent, at least 60 weight percent, at least 70 weight percent, at least 80 weight percent, at least 90 weight percent, or at least 95 weight percent of a monomer having two or more polymerizable groups.

Often, a monomer having two or more polymerizable groups contains monomeric impurities having fewer polymerizable groups. For example, a monomer having three or more polymerizable groups can contain impurities with two polymerizable groups, one polymerizable group, or both.

The precursor composition generally contains 15 to 95 weight percent polymerizable material based on the total weight of the precursor composition. For example, the precursor composition contains at least 15 weight percent, at least 20 weight percent, at least 25 weight percent, at least 30 weight percent, at least 40 weight percent, or at least 50 weight percent polymerizable material. The precursor composition can include up to 95 weight percent, up to 90 weight percent, up to 80 weight percent, up to 75 weight percent, up to 70 weight percent, or up to 60 weight percent polymerizable material. In some precursor compositions, the amount of polymerizable material is in the range of 15 to 90 weight percent, 20 to 90 weight percent, 30 to 90 weight percent, 40 to 90 weight percent, or 40 to 80 weight percent based on the total weight of the precursor composition.

The polymerizable material often includes one or more (meth)acrylates. As used herein, the term "(meth)acrylate" refers to a methacrylate, acrylate, or mixture thereof. The (meth)acrylate contains a (meth)acryloyl group. The term "(meth)acryloyl" refers to a monovalent group of formula $H_2C{=}CR^b{-}(CO){-}$ where $R^b$ is hydrogen or methyl and (CO) denotes that the carbon is attached to the oxygen with a double bond. The (meth)acryloyl group is the polymerizable group (i.e., the ethylenically unsaturated group) of the (meth) acrylate that is capable of free-radical polymerization. All the polymerizable materials can be (meth)acrylates or the polymerizable materials can include one or more (meth)acrylates in combination with other monomers that have ethylenically unsaturated groups.

In many embodiments, the polymerizable material includes a poly(alkylene oxide (meth)acrylate). The terms poly(alkylene oxide (meth)acrylate), poly(alkylene glycol (meth)acrylate), alkoxylated (meth)acrylate, and alkoxylated poly(meth)acrylate can be used interchangeably to refer to a (meth)acrylate having at least one group that contains two or more alkylene oxide residue units (also referred to as alkylene oxide units). There are often at least 5 alkylene oxide residue units. The alkylene oxide unit is a divalent group of formula —OR— where R is an alkylene having up to 10 carbon atoms, up to 8 carbon atoms, up to 6 carbon atoms, or up to 4 carbon atoms. The alkylene oxide units are often selected from ethylene oxide units, propylene oxide units, butylene oxide units, or mixtures thereof.

As long as the average number of ethylenically unsaturated groups (e.g., (meth)acryloyl groups) per monomer molecule is greater than 1.0, the polymerizable material can include a single (meth)acrylate or a mixture of (meth)acrylates. To provide an average number of (meth)acryloyl groups per monomer molecule greater than 1.0, at least some of the (meth)acrylate present in the polymerizable material has two or more (meth)acryloyl groups per monomer molecule. For example, the polymerizable material can contain a (meth) acrylate having two (meth)acryloyl groups per monomer molecule or can contain a mixture of a (meth)acrylate having two (meth)acryloyl groups per monomer molecule in combination with one or more (meth)acrylates having one (meth) acryloyl group per monomer molecule. In another example, the polymerizable material can contain a (meth)acrylate having three (meth)acryloyl groups per monomer molecule or can contain a mixture of a (meth)acrylate having three (meth) acryloyl groups per monomer molecule in combination with one or more (meth)acrylates having one (meth)acryloyl group per monomer molecule, two (meth)acryloyl groups per monomer molecule, or a mixture thereof.

Specific examples of suitable polymerizable materials with one ethylenically unsaturated group per monomer molecule include, but are not limited to, 2-hydroxyethyl (meth)acrylate, 2-hydroxypropyl(meth)acrylate, 3-hydroxypropyl (meth)acrylate, 4-hydroxybutyl(meth)acrylate, (meth)acrylonitrile, (meth)acrylamide, caprolactone (meth)acrylate, poly(alkylene oxide (meth)acrylate) (e.g., poly(ethylene oxide (meth)acrylate), poly(propylene oxide (meth)acrylate), and poly(ethylene oxide-co-propylene oxide (meth)acrylate)), alkoxy poly(alkylene oxide (meth)acrylate), (meth) acrylic acid, β-carboxyethyl(meth)acrylate, tetrahydrofurfuryl(meth)acrylate, N-vinyl pyrrolidone, N-vinylcaprolactam, N-alkyl(meth)acrylamide (e.g., N-methyl(meth)acrylamide), and N,N-dialkyl(meth)acrylamide (e.g., N,N-dimethyl (meth)acrylamide).

Suitable polymerizable materials with two ethylenically unsaturated groups per monomer molecule include, for example, alkoxylated di(meth)acrylates. Examples of alkoxylated di(meth)acrylates include, but are not limited to, poly(alkylene oxide di(meth)acrylates) such as poly(ethylene oxide di(meth)acrylates) and poly(propylene oxide di(meth) acrylates); alkoxylated diol di(meth)acrylates such as ethoxylated butanediol di(meth)acrylates, propoxylated butanediol di(meth)acrylates, and ethoxylated hexanediol di(meth)acrylates; alkoxylated trimethylolpropane di(meth)acrylates such as ethoxylated trimethylolpropane di(meth)acrylate and propoxylated trimethylolpropane di(meth)acrylate; and alkoxylated pentaerythritol di(meth)acrylates such as ethoxylated pentaerythritol di(meth)acrylate and propoxylated pentaerythritol di(meth)acrylate.

Examples of suitable polymerizable materials with three ethylenically unsaturated groups per monomer molecule include, for example, alkoxylated tri(meth)acrylates. Examples of alkoxylated tri(meth)acrylates include, but are not limited to, alkoxylated trimethylolpropane tri(meth)acrylates such as ethoxylated trimethylolpropane tri(meth)acrylates, propoxylated trimethylolpropane tri(meth)acrylates, and ethylene oxide/propylene oxide copolymer trimethylolpropane tri(meth)acrylates; and alkoxylated pentaerythritol tri(meth)acrylates such as ethoxylated pentaerythritol tri (meth)acrylates.

Suitable polymerizable materials with at least four ethylenically unsaturated groups per monomer include, for example, alkoxylated tetra(meth)acrylates and alkoxylated penta(meth)acrylates. Examples of alkoxylated tetra(meth) acrylates include alkoxylated pentaerythritol tetra(meth) acrylates such as ethoxylated pentaerythritol tetra(meth) acrylates.

In some embodiments, the polymerizable material includes a poly(alkylene oxide (meth)acrylate) having at least 2 (meth)acryloyl groups per monomer molecule. The alkoxylated portion (i.e., the poly(alkylene oxide) portion) often has at least 5 alkylene oxide units selected from ethylene oxide units, propylene oxide units, butylene oxide units, or a combination thereof. That is, each mole of the poly(alkylene oxide (meth)acrylate) contains at least 5 moles of alkylene oxide units. The plurality of alkylene oxide units facilitates the solubility of the poly(alkylene oxide (meth)acrylate) in the polar solvent. Some exemplary poly(alkylene oxide (meth)acrylates) contain at least 6 alkylene oxide units, at least 8 alkylene oxide units, at least 10 alkylene oxide units, at least 12 alkylene oxide units, at least 15 alkylene oxide units, at least 20 alkylene oxide units, or at least 30 alkylene oxide units. The poly(alkylene oxide (meth)acrylate) can contain poly(alkylene oxide) chains that are homopolymer chains, block copolymer chains, random copolymer chains, or mixtures thereof. In some embodiments, the poly(alkylene oxide) chains are poly(ethylene oxide) chains.

Any molecular weight of this poly(alkylene oxide (meth) acrylate) having at least 2 (meth)acryloyl groups and at least 5 alkylene oxide units can be used as long as polymeric fibers can be formed from the precursor composition. The weight average molecular weight of this poly(alkylene oxide (meth) acrylate) is often no greater than 2000 g/mole, no greater than 1800 g/mole, no greater than 1600 g/mole, no greater than 1400 g/mole, no greater than 1200 g/mole, or no greater than 1000 g/mole. In other applications, however, it is desirable to include a poly(alkylene oxide (meth)acrylate) in the polymerizable material that has a weight average molecular weight greater than 2000 g/mole.

The preparation of some exemplary poly(alkylene oxide (meth)acrylates) having multiple (meth)acryloyl groups are described in U.S. Pat. No. 7,005,143 (Abuelyaman et al.) as well as in U.S. Patent Application Publication Nos. 2005/0215752 A1 (Popp et al.), 2006/0212011 A1 (Popp et al.), and 2006/0235141 A1 (Riegel et al.). Suitable poly(alkylene oxide (meth)acrylates) having an average (meth)acryloyl functionality per monomer molecule equal to at least 2 and having at least 5 alkylene oxide units are commercially available, for example, from Sartomer (Exton, Pa.) under the trade designations "SR9035" (ethoxylated (15) trimethylolpropane triacrylate), "SR499" (ethoxylated (6) trimethylolpropane triacrylate), "SR502" (ethoxylated (9) trimethylolpropane triacrylate), "SR415" (ethoxylated (20) trimethylolpropane triacrylate), and "CD501" (propoxylated (6) trimethylolpropane triacrylate) and "CD9038" (ethoxylated (30) bis-phenol A diacrylate). The number in parentheses refers to the average number of alkylene oxide units per monomer molecule. Other suitable poly(alkylene oxide (meth)acrylates) include polyalkoxylated trimethylolpropane triacrylates such as those commercially available from BASF (Ludwigshafen, Germany) under the trade designation "LAROMER" with at least 30 alkylene oxide units.

The polymerizable material often includes at least 5 weight percent poly(alkylene oxide (meth)acrylate) having at least 2 (meth)acryloyl groups per monomer molecule and having at least 5 alkylene oxide units. For example, the polymerizable material can contain at least 10 weight percent, at least 20 weight percent, at least 30 weight percent, at least 40 weight percent, at least 50 weight percent, at least 60 weight percent, at least 70 weight percent, at least 80 weight percent, at least 90 weight percent, or at least 95 weight percent of the poly (alkylene oxide (meth)acrylate having at least 2 (meth)acryloyl groups per monomer and having at least 5 alkylene oxide units.

Some exemplary precursor compositions contain a poly (alkylene oxide (meth)acrylate) having at least 2 (meth)acryloyl groups per monomer molecule, having at least 5 ethylene oxide units, and having a weight average molecular weight less than 2000 g/mole. This polymerizable material can be the only polymerizable material in the precursor composition or can be combined with other monomers that are miscible in the polar solvent. More specific exemplary precursor compositions contain a poly(ethylene oxide) (meth)acrylate having at least 2 (meth)acryloyl groups per monomer molecule, having at least 5 alkylene oxide units, and having a weight average molecular weight less than 2000 g/mole. An even more specific exemplary precursor composition can include an ethoxylated trimethylolpropane triacrylate having a weight average molecular weight less than 2000 g/mole. Often the ethoxylated trimethylolpropane triacrylate contains impurities having one (meth)acryloyl group, two (meth)acryloyl groups, or mixtures thereof. For example, commercially available "SR415" (ethoxylated (20) trimethylolpropane triacrylate), often has an average functionality per monomer molecule less than 3 (when analyzed, the average functionality per monomer molecule was about 2.5).

In addition to the poly(alkylene oxide (meth)acrylate) having at least 2 (meth)acryloyl groups per monomer molecule and at least 5 alkylene oxide units, the precursor composition can include other monomers that are added to impart certain characteristics to the polymeric fiber. In some instances, the precursor composition can contain an anionic monomer. As used herein, the term "anionic monomer" refers to a monomer that contains an ethylenically unsaturated group in addition to an acidic group selected from a carboxylic acid (i.e., carboxy) group (—COOH) or a salt thereof, a sulfonic acid group (—$SO_3H$) or a salt thereof, a sulfate group (—$SO_4H$) or a salt thereof, a phosphonic acid group (—$PO_3H_2$) or a salt thereof, a phosphate group (—$OPO_3H$) or a salt thereof, or a mixture thereof. Depending on the pH of the precursor composition, the anionic monomer can be in a neutral state (acidic form) or in the form of a salt (anionic form). The counterions of the anionic form are often selected from alkali metals, alkaline earth metals, ammonium ion, or an ammonium ion substituted with various alkyl groups such as a tetraalkylammonium ion.

Suitable anionic monomers having carboxy groups include, but are not limited to, acrylic acid, methacrylic acid, and various carboxyalkyl(meth)acrylates such as 2-carboxyethylacrylate, 2-carboxyethylmethacrylate, 3-carboxypropylacrylate, and 3-carboxypropylmethacrylate. Other suitable anionic monomers with carboxy groups include (meth)acryloylamino acids such as those described in U.S. Pat. No. 4,157,418 (Heilmann), incorporated herein by reference. Exemplary (meth)acryloylamino acids include, but are not limited to, N-acryloylglycine, N-acryloylaspartic acid, N-acryloyl-β-alanine, and 2-acrylamidoglycolic acid. Suitable anionic monomers having sulfonic acid groups include, but are not limited to, various (meth)acrylamidosulfonic acids such as N-acrylamidomethanesulfonic acid, 2-acrylamidoethanesulfonic acid, 2-acrylamido-2-methylpropanesulfonic acid, and 2-methacrylamido-2-methylpropanesulfonic acid. Suitable anionic monomers having phosphonic acid groups include, but are not limited to, (meth)acrylamidoalkylphosphonic acids such as 2-acrylamidoethylphosphonic acid and 3-methacrylamidopropylphosphonic acid. Suitable anionic monomers having phosphate groups include phosphates of alkylene glycol (meth)acrylates such as phosphates of ethylene glycol (meth)acrylate and phosphates of propylene glycol (meth)acrylate. Salts of any of these acidic monomers can also be used.

The anionic monomer, if present, can increase the degree of swelling of the polymeric fiber. That is, the degree of swelling can often be altered by varying the amount of the anionic monomer as well as the amount of other hydrophilic monomer(s) in the precursor composition. The degree of swelling is usually proportional to the total amount of polar solvent that can be sorbed by the polymeric fiber. The anionic monomer is often present in an amount ranging from 0 to 50 weight percent based on the total weight of the polymerizable material. For example, the precursor composition can contain up to 40 weight percent, up to 30 weight percent, up to 20 weight percent, up to 15 weight percent, or up to 10 weight percent anionic monomer. The precursor composition in some examples contain at least 0.5 weight percent, at least 1 weight percent, at least 2 weight percent, or at least 5 weight percent anionic monomer. Some precursor compositions do not contain an anionic monomer.

In other embodiments, the precursor composition can include a cationic monomer. As used herein, the term "cationic monomer" refers to a monomer having an ethylenically unsaturated group as well as an amino group, a salt of an amino group, or a mixture thereof. For example, the cationic monomer can be an amino(meth)acrylate or an amino (meth) acrylamide. The amino group can be a primary amino group or a salt thereof, a secondary amino group or a salt thereof, a tertiary amino group or a salt thereof, or a quaternary salt. The cationic monomers often include a tertiary amino group or a salt thereof or a quaternary ammonium salt. Depending on the pH of the precursor composition, some cationic monomer can be in a neutral state (basic form) or in the form of a salt (cationic form). The counterions of the cationic form are often selected from halides (e.g., bromides or chlorides), sulfates, alkylsulfates (e.g., methosulfate or ethosulfate), as well as various carboxylate anions (e.g., acetate).

Exemplary amino(meth)acrylates include N,N-dialkylaminoalkyl(meth)acrylates and N-alkylaminoalkyl(meth) acrylates such as, for example, N,N-dimethylaminoethylmethacrylate, N,N-dimethylaminoethylacrylate, N,N-diethylaminoethylmethacylate, N,N-diethylaminoethylacrylate, N,N-dimethylaminopropylmethacrylate, N,N-dimethylaminopropylacrylate, N-tert-butylaminopropylmethacrylate, and N-tert-butylaminopropylacrylate.

Exemplary amino(meth)acrylamides include, for example, N-(3-aminopropyl)methacrylamide, N-(3-aminopropyl) acrylamide, N-[3-(dimethylamino)propyl]methacrylamide, N-(3-imidazolylpropyl)methacrylamide, N-(3-imidazolylpropyl)acrylamide, N-(2-imidazolylethyl)methacrylamide, N-(1,1-dimethyl-3-imidazolylpropyl)methacrylamide, N-(1,1-dimethyl-3-imidazolylpropyl)acrylamide, N-(3-benzoimidazolylpropyl)acrylamide, and N-(3-benzoimidazolylpropyl)methacrylamide.

Exemplary monomeric quaternary ammonium salts include, but are not limited to, (meth)acrylamidoalkyltrimethylammonium salts (e.g., 3-methacrylamidopropyltrimethylammonium chloride and 3-acrylamidopropyltrimethylammonium chloride) and (meth) acryloxyalkyltrimethylammonium salts (e.g., 2-acryloxyethyltrimethylammonium chloride, 2-methacryloxyethyltrimethylammonium chloride, 3-methacryloxy-2-hydroxypropyltrimethylammonium chloride, 3-acryloxy-2-hydroxypropyltrimethylammonium chloride, and 2-acryloxyethyltrimethylammonium methyl sulfate).

Other exemplary monomeric quaternary ammonium salts include a dimethylalkylammonium group with the alkyl group having 2 to 22 carbon atoms or 2 to 20 carbon atoms. That is, the monomer includes a group of formula —$N(CH_3)_2(C_nH_{2n+1})^+$ where n is an integer having a value of 2 to 22. Exemplary monomers include, but are not limited to monomers of the following formula

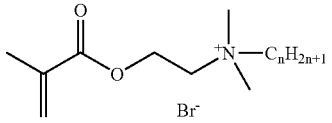

where n is an integer in the range of 2 to 22. The synthesis of these monomers is described in U.S. Pat. No. 5,437,932 (Ali et al.). These monomers can be prepared, for example, by combining dimethylaminoethylmethacrylate salt, acetone, 1-bromoalkane having 2 to 22 carbon atoms, and optionally, an antioxidant. The resulting mixture may be stirred for about 16 hours at about 35° C. and then allowed to cool to room temperature. The resulting white solid precipitate may then be isolated by filtration, washed with cold ethyl acetate, and dried under vacuum at 40° C.

Some cationic monomers, such as those having a quaternary amino group, can impart antimicrobial properties to the polymeric fiber. The cationic monomer is often present in an amount ranging from 0 to 50 weight percent based on the total weight of the polymerizable material. For example, the precursor composition can contain up to 40 weight percent, up to 30 weight percent, up to 20 weight percent, up to 15 weight percent, or up to 10 weight percent. The precursor composition in some examples contain at least 0.5 weight percent, at least 1 weight percent, at least 2 weight percent, or at least 5 weight percent cationic monomer. Some precursor compositions do not contain a cationic monomer.

Some exemplary polymerizable materials contain only nonionic monomers. That is, the polymerizable material is substantially free of both anionic monomers and cationic monomers. As used herein with reference to the anionic or cationic monomers, "substantially free" means that the polymerizable material contains less than 1 weight percent, less than 0.5 weight percent, less than 0.2 weight percent, or less than 0.1 weight percent anionic monomer or cationic monomer based on the weight of the polymerizable material. For example, any ionic monomers that are present may be present as an impurity in another monomer.

In some embodiments, the precursor compositions contain (a) 5 weight percent to 85 weight percent polar solvent based on a total weight of the precursor composition and (b) 15 weight percent to 95 weight percent polymerizable material based on a total weight of the precursor composition. The polymerizable material is miscible in the polar solvent and has an average number of ethylenically unsaturated groups per monomer molecule greater than 1.0. The polymerizable material includes a poly(alkylene oxide (meth)acrylate) having at least 2 (meth)acryloyl groups and having at least 5 alkylene oxide units.

In addition to the polar solvent and the polymerizable material, the precursor composition can include one or more optional additives such as processing agents, active agents, or mixtures thereof. Any of these optional additives can be dissolved in the precursor composition or dispersed in the precursor composition.

As used herein, the term "processing agent" refers to a compound or mixture of compounds that is added primarily to alter the physical or chemical characteristics of either the precursor composition or the polymeric material. That is, the processing agent is added for the purpose of altering the precursor composition or facilitating the formation of the polymeric material. If added, the processing agent is typically added to the precursor composition. These processing agents are typically not considered to be active agents.

Suitable processing agents include, but are not limited to, rheology modifiers such as polymeric thickeners (such as gum, cellulose, pectin, and the like) or inorganic thickeners (such as clays, silica gels, and the like), surfactants that modify the surface tension, emulsifiers that stabilize the precursor composition, solubilizers that enhance the solubility of the monomers in the polar solvent, initiators to facilitate the polymerization reaction of the polymerizable material, chain transfer or retarding agents, binders, dispersants, fixatives, foaming agents, flow aids, foam stabilizers, foam boosters, gellants, glossers, propellants, waxes, compounds to depress the freezing point and/or increase the boiling point of the precursor composition, and plasticizers.

Any optional processing agent is typically present in an amount no greater than 20 weight percent, no greater than 15 weight percent, no greater than 10 weight percent, no greater than 8 weight percent, no greater than 6 weight percent, no greater than 4 weight percent, no greater than 2 weight percent, no greater than 1 weight percent, or no greater than 0.5 weight percent based on the total weight of the precursor composition.

One exemplary processing agent is an initiator. Most precursor compositions include an initiator for the free-radical polymerization reaction. The initiator can be a photoinitiator, a thermal initiator, or a redox couple. The initiator can be either soluble in the precursor composition or dispersed in the precursor composition.

An example of a suitable soluble photoinitiator is 2-hydroxy-1-[4-(2-hydroxyethoxy)phenyl]-2-methyl-1-propanone, which is commercially available under the trade designation "IRGACURE 2959" from Ciba Specialty Chemicals (Tarrytown, N.Y.). An example of a suitable dispersed photoinitiator is alpha,alpha-dimethoxy-alpha-phenylacetophenone, which is commercially available under the trade designation "IRGACURE 651" from Ciba Specialty Chemicals. Other suitable photoinitiators are the acrylamidoacetyl photoinitiators, described in U.S. Pat. No. 5,506,279, that contain a polymerizable group as well as a group that can function as an initiator. The initiator is usually not a redox initiator as used in some polymerizable compositions known in the art. Such initiators could react with bioactive agents, if present.

Suitable thermal initiators include, for example, azo compounds, peroxides or hydroperoxides, persulfates, or the like. Exemplary azo compounds include 2,2'-azobis[2-(2-imidazolin-2-yl)propane]dihydrochloride, 2,2'-azobis(2-amidinopropane)dihydrochloride, and 4,4'-azobis-(4-cyanopentanoic acid). Examples of commercially available thermal azo compound initiators include materials available from DuPont Specialty Chemical (Wilmington, Del.) under the "VAZO" trade designation such as "VAZO 44", "VAZO 56", and "VAZO 68". Suitable peroxides and hydroperoxides include acetyl peroxide, t-butyl hydroperoxide, cumene hydroperoxide, and peroxyacetic acid. Suitable persulfates include, for example, sodium persulfate and ammonium persulfate.

In other examples, the free radical initiator is a redox couple such as ammonium or sodium persulfate and N,N,N',N'-tetramethyl-1,2-diaminoethane; ammonium or sodium persulfate and ferrous ammonium sulfate; hydrogen peroxide and ferrous ammonium sulfate; cumene hydroperoxide and N,N-dimethylaniline; or the like.

In some embodiments, the precursor composition includes only the polymerizable material, the polar solvent, and an initiator such as a photoinitiator. In most embodiments, the initiator is present in an amount equal to no more than 4 weight percent, no greater than 3 weight percent, no more than 2 weight percent, no more than 1 weight percent, or no more than 0.5 weight percent based on the total weight of the precursor composition.

The precursor composition can include one or more optional active agents. The active agent provides some added functionality to the polymeric fiber. The polymeric fiber functions as a carrier for the active agent. If present, the active agents are usually present in an amount no greater than 30 weight percent, no greater than 25 weight percent, no greater than 20 weight percent, no greater than 15 weight percent, no greater than 10 weight percent, or no greater than 5 weight percent based on a total weight of the precursor composition.

In some embodiments, the active agent can migrate into and out of the polymeric fiber. In other embodiments, the active agent tends to be stationary and remain within the polymeric fiber. For example, the molecular size of the active agent may prevent elution or diffusion of the active agent out of the fiber. In another example, the active agent may be attached to the fiber with a covalent or ionic bond. Active agents optionally can have one or more ethylenically unsaturated groups that can react with other ethylenically unsaturated groups to become part of the polymeric material or to become attached to the polymeric material in the fiber.

Some active agents are biologically active agents. As used herein, the terms "biologically active agent" and "bioactive agent" are used interchangeably and refer to a compound or mixture of compounds that has some known effect on living systems such as, for example, a bacteria or other microorganisms, plant, fish, insect, or mammal. The bioactive agent is added for the purpose of affecting the living system such as affecting the metabolism of the living system. Examples of bioactive agents include, but are not limited to, medicaments, herbicides, insecticides, antimicrobial agents, disinfectants and antiseptic agents, local anesthetics, astringents, antifungal agents, antibacterial agents, growth factors, vitamins, herbal extracts, antioxidants, steroids or other anti-inflammatory agents, compounds that promote wound healing, vasodilators, exfoliants such as alpha-hydroxy acids or beta-hydroxy acids, enzymes, nutrients, proteins, and carbohydrates. Still other bioactive agents include artificial tanning agents, tanning accelerants, skin soothing agents, skin tightening agents, anti-wrinkle agents, skin repair agents, sebum inhibiting agents, sebum stimulators, protease inhibitors, anti-itch ingredients, agents for inhibiting hair growth, agents for accelerating hair growth, skin sensates, anti-acne treatments, depilating agents, hair removers, corn removers, callus removers, wart removers, sunscreen agents, insect repellants, deodorants and antiperspirants, hair colorants, bleaching agents, and anti-dandruff agents. Any other suitable bioactive agent known in the art can be used.

Other active agents are not biologically active. These active agents are added to provide some non-biological functionality to the polymeric fiber. That is, these active agents are not added for the purpose of affecting a living system such as affecting the metabolism of the living system. Suitable active agents, for example, can be selected to alter the odor, charge, color, density, pH, osmolarity, water activity, ionic strength, or refractive index of the polymeric fiber. The active agent can also be selected to provide a reactive group or compound. Examples of non-biologically active agents include emulsifiers or surfactants (including anionic surfactants, cationic surfactants, zwitterionic surfactants, non-ionic surfactants, and combinations thereof), pigments, inorganic oxides (such as silicon dioxide, titania, alumina, and zirconia), fragrances such as aromatherapy agents and perfumes, odor absorbing agents, humectants, lubricants, dyes, bleaching or coloring agents, flavorings, decorative agents such as glitter, emollients, acids, bases, buffers, indicators, soluble salts, chelating agents, and the like. Some humectants that are liquids at room temperature that are miscible with water (e.g., glycols and other polyols) in the amounts used are considered to be part of the polar solvent when the percent composition of the swollen polymeric fiber or dried polymeric fiber is calculated.

In some embodiments, the active agent is an indicator. Any suitable chemistry can be used for the indicator. The indicator can detect, for example, a specific pH range or the presence of a specific class of compounds. The presence of some specific classes of compounds can result in a color change. Ninhydrin, for example, can be used to detect the presence of a protein or amino group. The indicator can also be a typical pH indicator such as methyl blue or phenolphthalein.

Nanoparticles of inorganic oxides can be added to the polymeric fibers to increase the refractive index of the fibers. For example, the polymeric fibers can be loaded with zirconia nanoparticles or titania nanoparticles. Zirconia nanoparticles can be prepared using the methods described, for example, in U.S. Pat. No. 6,376,590 (Kolb et al.) and U.S. Patent Publication No. 2006/0148950A1 (Davidson et al.).

Any of the active agents may have a polymerizable group. The use of a polymerizable group on the active agent can be used to prevent the migration of the active agent out of the polymeric fiber. Cationic monomers having an ethylenically unsaturated group as well as a quaternary amino group may function as an antimicrobial agent and can be included in the polymerizable material of the precursor composition. The cationic monomer is often a (meth)acrylate having a quaternary amino group.

Because the polymeric fibers typically have unreacted polymerizable groups, the polymeric fibers can be reacted post-formation with active agents having polymerizable groups. For example, a cationic monomer having an ethylenically unsaturated group and a quaternary amino group can be reacted with the polymeric fibers having unreacted ethylenically unsaturated groups. A mixture containing the polymeric fibers, the cationic monomer, and a photoinitiator can be exposed to actinic radiation to react the ethylenically unsaturated group of the cationic monomer with an unreacted ethylenically unsaturated group of the polymeric fiber. The reaction product is a polymeric fiber with attached quaternary amino groups.

The method of forming polymeric fibers includes providing a precursor composition and forming a stream of the precursor composition that surrounded by a gas phase. The method further includes exposing the stream to radiation for a time sufficient to at least partially polymerize the polymerizable material in the precursor composition and to form a first swollen polymeric fiber.

Any of the precursor compositions described above can be used in the method of forming polymeric fibers. The polymerizable material included in the precursor composition has an average number of ethylenically unsaturated groups per monomer molecule greater than 1.0. In some embodiments, the polymerizable material includes a poly(alkylene oxide (meth)acrylate) having at least 2 (meth)acryloyl groups and having at least 5 alkylene oxide units.

Upon exposure to radiation, the polymerizable material within the precursor composition undergoes a free-radical polymerization reaction. As used herein, the term "radiation" refers to actinic radiation (e.g., radiation having a wavelength in the ultraviolet or visible region of the spectrum), accelerated particles (e.g., electron beam radiation), thermal (e.g., heat or infrared radiation), or the like. The radiation is often actinic radiation or accelerated particles, because these energy sources tend to provide good control over the initiation and rate of polymerization. Additionally, actinic radiation and accelerated particles can be used for curing at relatively low temperatures. This avoids degrading components that might be sensitive to the relatively high temperatures that might be required to initiate the polymerization reaction with thermal radiation. Any suitable actinic radiation sources that can produce energy in the desired region of the electromagnetic spectrum can be used. Exemplary sources of actinic radiation include mercury lamps, xenon lamps, carbon arc lamps, tungsten filament lamps, lasers, sunlight, and the like.

Figure 2:
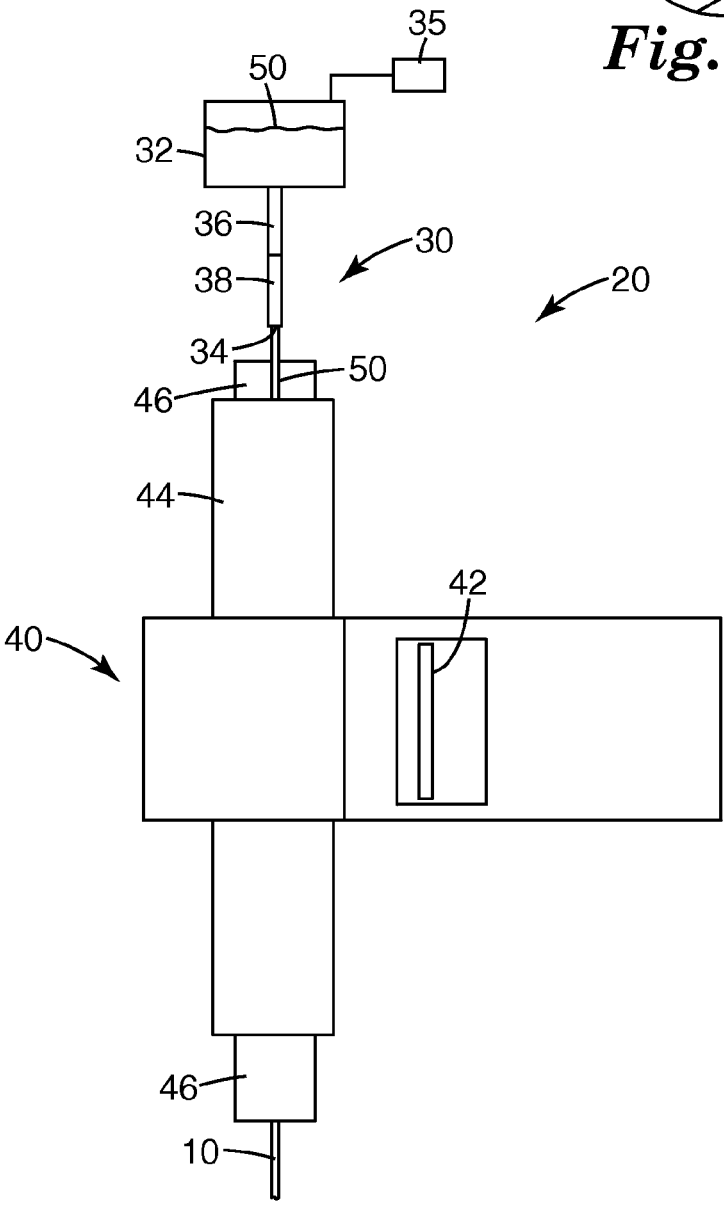
FIG. 2 is a schematic diagram of a first embodiment of a process and equipment for making the fibers of FIG. 1.

FIG. 2 is a schematic representation of one exemplary process for making polymeric fibers. Process 20 includes a feed system 30 and a polymerization system 40. Precursor composition 50, which contains at least polymerizable material and a polar solvent, is provided to feed system 30. Within polymerization system 40, the polymerizable material in the precursor composition 50 is exposed to radiation and undergoes a free-radical polymerization reaction to form polymeric material.

Feed system 30 includes a pressure source 35 that applies pressure to precursor composition 50. The pressure is usually less than 50 pounds per square inch (psi), less than 40 psi, or less than 30 psi. For example, the pressure is sometimes in the range of 20 to 30 psi. From polymerization system 40, a swollen polymeric fiber is obtained. The swollen polymeric fiber is usually homogeneous and has an aspect ratio greater than 3:1. Each of feed system 30 and polymerization system 40 of process 20 can include various elements.

Feed system 30 includes a reservoir 32 and at least one outlet 34. Reservoir 32 may be a pot or other vessel into which a volume of precursor composition can be poured or otherwise added and then placed under pressure. Reservoir 32 may be metal, plastic, glass, or other material. Preferably, precursor composition 50 does not adhere to or react with reservoir 32, or is otherwise easily removed from reservoir 32. Reservoir 32 is sufficiently strong to withstand pressures provided by pressure source 35. This pressure is often at least 5 psi, at least 10 psi, at least 20 psi, or at least 30 psi. Outlet 34 may be as simple as an aperture or hole in receiver 32, or may be a separate element, such as an ultrasonic atomizer. In the embodiment shown in FIG. 2, outlet 34 is merely an aperture in receiver 32. The outlet 34 facilitates the formation of a a stream of the precursor composition 50. Connecting reservoir 32 to outlet 34 can involve the use of any suitable piping. In one particular embodiment, a first (e.g., flexible) feed line 36 provides precursor composition 50 from reservoir 32 to a second (e.g., rigid) feed line 38, which in turns provides composition 50 to outlet 34 and polymerization system 40. Polymerization system 40 includes a radiation source 42 and a shielding device 44. The shielding device 44 is often present to direct the radiation from source 42 to the desired location and to shield persons or equipment that may be in close proximity.

Polymerization system 40, in this embodiment, also includes a management element 46 that protects or isolates precursor composition 50 (e.g., stream of the precursor composition 50) from any high velocity air flow that may occur from radiation source 42. The management element 46 can allow control of the local environment where polymerization occurs. That is, management element 46 can be used to control the composition of the gas phase that surrounds the stream of precursor composition 50 as the stream is exposed to radiation source 42.

The radiation source 42 may be a single radiation source or a plurality of radiation sources that are the same or different. Radiation source 42 provides energy such as infrared radiation, visible radiation, ultraviolet radiation, electron beam radiation, microwave radiation, or radio frequency radiation. The particular energy source used will depend upon the particular precursor composition 50. Suitable non-ionizing radiation sources include continuous and pulsed sources and may be broadband or narrowband sources such as monochromatic sources. Exemplary non-ionizing radiation sources include, but are not limited to, mercury lamps (such as low, medium, and high-pressure versions as well as their additive or doped versions), fluorescent lamps, germicidal lamps, metal halide lamps, halogen lamps, light emitting diodes, lasers, excimer lamps, pulsed xenon lamps, tungsten lamps, and incandescent lamps. Infrared radiation sources and microwave radiation sources may be used, as well as ionizing radiation sources such as electron beams. A combination of radiation sources may also be used.

In some exemplary methods, electromagnetic radiation having a wavelength in the range of 100 to 1000 nanometers, 100 to 800 nanometers, or 100 to 700 nanometers can be used. In some methods, ultraviolet radiation having a wavelength in the range of 100 to 400 nanometers or 200 to 400 nanometers can be used. Ultraviolet radiation at wavelengths below 200 nm from excimer sources, for example, can be used. In many embodiments, radiation source 42 is a high-radiance ultraviolet source, such as a medium-pressure mercury lamp of at least 100 W/inch (40 W/cm). Low-radiance lamps, including low-pressure mercury lamps such as germicidal lamps, can also be used.

Shielding device 44 can be any suitable shape and material to inhibit radiation from source 42 from contacting persons or equipment in close proximity. Shielding devices 44 are well known in the art of radiation.

Management element 46, if present, can be any suitable shape and material to isolate or protect the fall or flow of precursor composition 50 past radiation source 42. In most processes, management element 46 is transparent or at least partially transparent to radiation from source 42. An example of element 46 is a quartz tube through which a stream of the precursor composition 50 are passed.

During production of fiber 10, precursor composition 50 is delivered (e.g., poured) into reservoir 32, for example through an open top. Pressure is applied to precursor composition 50 using pressure source 35, and precursor composition 50 is expelled through outlet 34. The pressure within reservoir 32 is greater than atmospheric pressure in order to force precursor composition 50 out from reservoir 32 through outlet 34. Usually, the pressure is at least 5 psi, at least 10 psi, at least 20 psi, or at least 30 psi above atmospheric pressure.

Precursor composition 50 preferably remains a stream for some distance as it falls (e.g., free-falls) through polymerization system 40. This distance is determined, for example, by the precursor composition and viscosity of the stream. Composition 50 passes through (e.g., falls through) polymerization system 40 generally affected only by natural forces such as gravity or other optional forces such as air currents, thermal convective currents, surface tension, or the like. Typically, falling composition 50 has some side-to-side movement as it falls through management element 46.

The precursor composition 50 stream is often surrounded by a gas phase. The gas usually surrounds the precursor composition, the forming fiber, the formed fiber, or a combination thereof in the polymerization zone. For example, a gas often surrounds multiple sides of the polymeric fiber as it is formed. More particularly, a gas typically surrounds the major axis (i.e., length) of the polymeric fiber as it is formed. The gas phase can be greater than atmospheric pressure, equal to atmospheric pressure, or less then atmospheric pressure. In some embodiments, the gas phase can be ambient air. In other embodiments, gas streams or other atmospheric features may be used to stabilize the flow of precursor composition 50 through polymerization system 40. For example, an inert atmosphere can be used. Suitable inert atmospheres can include, for example, argon, helium, nitrogen, or mixture thereof.

Swollen polymeric fibers 10 are obtained from polymerization system 40. The duration of time within the polymerization system is at least greater than the minimum amount of time required to obtain a polymeric fiber. The duration of the precursor composition 50 within polymerization system 40 or the time of exposure of precursor composition 50 to radiation is generally no more than 10 seconds, no more than 5 seconds, no more than 3 seconds, no more than 2.5 seconds, no more than 2 seconds, no more than 1 second, or no more than 0.5 second.

Figure 3:
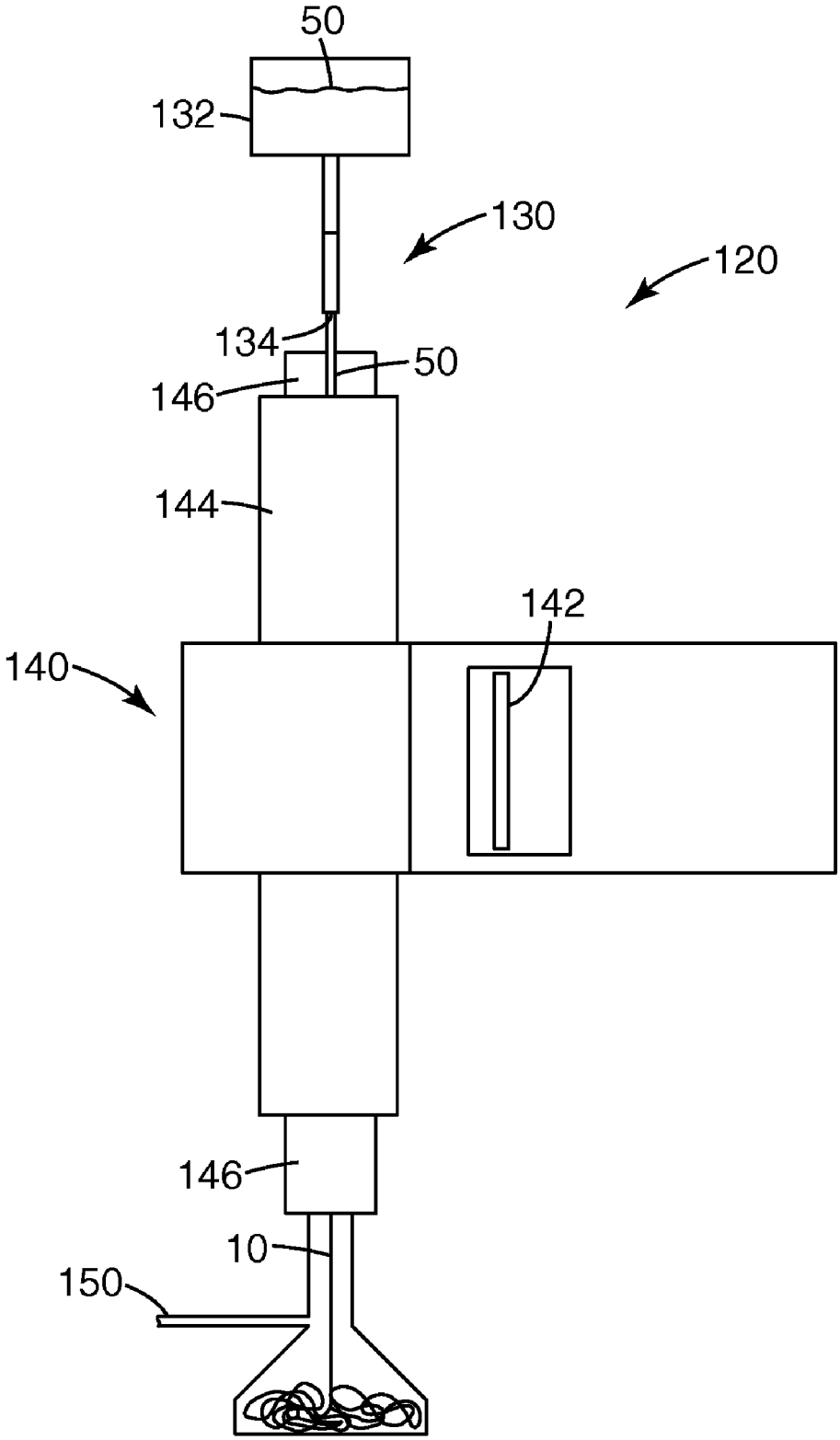
FIG. 3 is a schematic diagram of a second embodiment of a process and equipment for making the fibers of FIG. 1.

A second suitable process for making polymeric fibers is schematically illustrated in FIG. 3. In the most basic form, process 120 includes a feed system 130 and a polymerization system 140. Precursor composition 50, as described above, is provided to feed system 130, which passes it to polymerization system 140. From polymerization system 140, homogeneous, swollen polymeric fiber is obtained. Each feed system 130 and polymerization system 140 of process 120 includes various elements.

Feed system 130 can be similar to system 30 described above, having a reservoir 132 with at least one outlet 134. Polymerization system 140 can be similar to system 40 described above, having a radiation source 142, a shielding device 144, and a management element 146 to isolate or protect composition 50 through polymerization system 140. Process 120 also includes a vacuum source 150, for applying a vacuum into polymerization system 140. An example of a suitable vacuum source 150 is a water aspirator or vacuum pump, and suitable vacuum levels include less than 500 torr, less than 100 torr, and in some embodiments less than 50 torr.

During production of fiber 10, precursor composition 50 is provided from reservoir 132 through outlet 134. Composition 50 is expelled as a stream from outlet 134, which falls through polymerization system 140 aided by the vacuum from vacuum source 150. Below polymerization system 140, polymeric fiber 10 is obtained.

The processes described above illustrate precursor composition 50 falling vertically from a reservoir through a polymerization system. Another alternate process configuration may have precursor composition 50 being expelled, for example, horizontally (or at any angle) from a reservoir, so that the path of precursor composition 50 prior to and/or through the polymerization system includes a horizontal vector. For example, fiber 10 could be formed by a blowing operation.

The polymeric fibers are not supported. That is, the polymeric fibers are formed without the use of an internal or external support. The polymeric material in the fiber extends across the entire diameter of the fiber. The polymeric fibers are not a coating for pre-formed articles such as other fibers, yarns, strings, wires, mesh, or the like. Further, the polymeric fibers are not formed from another pre-formed article. That is, the polymeric fibers are not cut, slit, or formed from a sheet, film, or foam.

The diameter of the swollen polymeric fiber is dependent on the process used to make it and the specific precursor composition. When a solution is flowed through an orifice, as in processes 20, 120 described above, the diameter of the swollen polymeric fiber obtained relates to the orifice diameter. The shape of the orifice may affect the cross-sectional shape of the fiber. For example, a non-circular orifice may produce a non-circular fiber. The swollen polymeric fiber often has a diameter up to 5000 micrometers, up to 4000 micrometers, up to 3000 micrometers, up to 2000 micrometers, or up to 10000 micrometers. The fiber diameter is often at least 1 micrometer, at least 5 micrometers, at least 10 micrometers, at least 20 micrometers, at least 25 micrometers, at least 30 micrometers, at least 40 micrometers, at least 50 micrometers, or at least 100 micrometers. In some embodiments, it may be desired to form thinner fiber (e.g., fibers having a diameter of about 250 micrometers or less) in an inert atmosphere.

The polymeric fibers can be of any length. In many embodiments, the length is in the range of 0.1 centimeters to 100 meters. For example, the length can be at least 0.1 centimeters, at least 0.2 centimeters, at least 0.5 centimeters, at least 1 centimeter, at least 2 centimeters, at least 5 centimeters, at least 10 centimeters, at least 20 centimeters, at least 50 centimeters, or at least 100 centimeters. The length of some exemplary polymeric fibers can be up to 100 meters, up to 50 meters, up to 10 meters, up to 2 meters, up to 1 meter, up to 0.5 meter (50 centimeters), up to 0.2 meter (20 centimeters), or up to 0.1 meter (10 centimeters).

Polymeric fibers are formed by subjecting streams of the precursor composition to radiation resulting in the free-radical polymerization of the polymerizable material. Because the precursor composition includes polar solvent in addition to the polymerizable material, the polymeric fibers are swollen with the polar solvent. The polymeric fiber can be described as a swollen fiber, a hydrogel fiber, a polymeric fiber swollen with solvent, or a swollen polymeric fiber. All these terms may be used interchangeably herein.

The polymeric material in the swollen polymeric fiber is crosslinked but can contain unreacted polymerizable or reactive groups. The unreacted polymerizable groups typically include ethylenically unsaturated groups capable of further free-radical reactions. Other types of polymerizable groups such as hydroxyl groups or amino groups can be present that are capable of condensation reactions or nucleophilic substitution reactions.

The swollen polymeric fibers generally include 15 weight percent to 95 weight percent polymeric material based on the weight of the swollen polymeric fiber. If less than 15 weight percent of the swollen polymeric fiber is polymeric material, there may not be sufficient polymeric material present to form a well-shaped fiber. If greater than 95 weight percent of the swollen polymeric fiber is polymeric material, the ability of a dried polymeric fiber to sorb a sorbate may be undesirably low.

In some exemplary swollen polymeric fibers, at least 15 weight percent, at least 20 weight percent, at least 25 weight percent, at least 30 weight percent, at least 40 weight percent, or at least 50 weight percent of the swollen polymeric fibers are polymeric material. Up to 95 weight percent, up to 90 weight percent, up to 85 weight percent, up to 80 weight percent, up to 75 weight percent, or up to 70 weight percent of the swollen polymeric fibers are polymeric material. For example, the swollen polymeric fibers can contain 15 to 90 weight percent, 15 to 85 weight percent, 20 to 80 weight percent, 30 to 80 weight percent, or 40 to 80 weight percent polymeric material.

The amount of polar solvent within the swollen polymeric fibers is often in the range of 5 weight percent to 85 weight percent of the swollen polymeric fiber. If the amount of polar solvent is greater than 85 weight percent, there may not be sufficient polymeric material present to form a well-shaped fiber. If the amount of the polar solvent is not at least 5 weight percent of the swollen polymeric fiber, the ability of the dried polymeric fiber to sorb additional liquids may be undesirably low. Any polar solvent included in the swollen polymeric fiber is usually not covalently bonded to the matrix. In some exemplary swollen polymeric fibers, at least 5 weight percent, at least 10 weight percent, at least 15 weight percent, at least 20 weight percent, at least 25 weight percent, at least 30 weight percent, or at least 40 weight percent of the swollen polymeric fibers are polar solvents. Up to 85 weight percent, up to 80 weight percent, up to 70 weight percent, up to 60 weight percent, or up to 50 weight percent of the swollen polymeric fibers are polar solvents.

In some embodiments, the swollen polymeric fibers can also contain an active agent. These active agents can be present in the precursor composition used to prepare the swollen polymeric fiber. Alternatively, the swollen polymeric fibers can be dried and swollen a second time with a sorbate. That is, the dried polymeric fiber can sorb the sorbate to form a second swollen polymeric fiber. The sorbate often includes an active agent. The active agent can be a biologically active agent, a non-biologically active agent, or a mixture thereof. Suitable active agents are described above.

When included in the precursor composition, the active agents are preferably stable and/or resistant to the radiation used to polymerize the material. Some active agents, however, can be a monomer with an ethylenically unsaturated group. Active agents that are not stable or resistant to radiation may fare better if added after formation of the polymeric fiber (i.e., the polymeric fiber can be dried and then exposed to a sorbate that includes the active agent). Unlike the active agents that often can be added either to the precursor composition or after formation of the polymeric fiber, the processing agents are typically included only in the precursor composition.

The amount of the active agent can be in the range of 0 to 30 weight percent based on the weight of the swollen polymeric fiber. In some exemplary swollen polymeric fibers, the amount of the active agent is no greater than 20 weight percent, no greater than 15 weight percent, no greater than 10 weight percent, no greater than 5 weight percent, no greater than 3 weight percent, no greater than 2 weight percent, or no greater than 1 weight percent of the swollen polymeric fiber.

Some exemplary swollen polymeric fibers contain 15 to 95 weight percent polymeric material, 5 to 85 weight percent polar solvent, and 0 to 30 weight percent active agent based on a total weight of the swollen polymeric fibers.

The swollen polymeric fibers such as those lacking an active agent are usually homogeneous and do not contain discernible internal pores or internal channels. The polymeric matrix, which includes the polar solvent and polymeric material, it usually present as a single phase in the swollen polymeric fiber, with no discernible boundary between the solvent and the polymeric material. If an active agent is present, however, the active agent may or may not be distributed homogeneously throughout the polymeric fiber. Further, the active agent may be present in a separate phase from the polymeric matrix.

Generally, the polymeric fibers (particularly those without an active agent) have no discernible porosity or voids when viewed under a microscope such as an environmental scanning electron microscope with magnification up to 50 times. The polymeric fibers often have no discernible porosity or voids when viewed under a field emission scanning electron microscope with a magnification up to 100 times, up to 500 times, up to 1000 times, up to 2000 times, up to 5000 times, up to 10,000 times, up to 20,000 times, or up to 50,000 times.

Swollen polymeric fibers that are prepared without the use of opaque components that might scatter light can be clear or transparent, with little or no opacity or haziness. In some embodiments, swollen polymeric fibers that are clear are preferred. In other embodiments, clarity is not necessary and various components can be added that may affect the appearance of the polymeric fibers.

The term "transparent" as used in reference to the polymeric fibers, means that the fibers do not scatter visible light in an amount that can be visually detected. In some embodiments, air may be entrained in the polymeric fibers, which can create opacity at the phase boundaries; however, this is not phase-separation of the polymeric material in the polar solvent. Compositions are considered transparent if at least 85 percent of light having a wavelength of 550 nanometers is transmitted through a film of the cured precursor composition having a thickness of 1 millimeter. These films can be cast onto glass or other non-interfering substrates. In some embodiments, at least 88 percent, at least 90 percent, at least 95 percent of light having a wavelength of 550 nanometers is transmitted through this film.

The haze or opacity can be characterized using a haze meter, such as a BYK-Gardner Hazegard Plus hazemeter, which has a broadband light source. The transmittance through this same film prepared from the precursor composition is at least 85 percent, at least 88 percent, at least 90 percent, or at least 95 percent with haze being less than 10 percent, less than 8 percent, less than 5 percent, or less than 3 percent. Haziness, in many embodiments, is indicative of phase-separation.

The fibers may be rigid or elastomeric and may or may not be easily crushed (e.g., friable). A higher content of polymeric material tends to increase the modulus and crush strength of the swollen polymeric fiber. A greater amount of crosslinking achieved by using a precursor composition with a higher average functionality also tends to increase the modulus and crush strength of the polymeric fibers. The average functionality refers to the average number of polymerizable groups (ethylenically unsaturated groups) per monomer molecule.

The polymer fibers can have a wide variety of sizes. The diameter of the fibers depends on the exact method used to generate the liquid stream of the precursor composition prior to radiation curing and can range from less than one micrometer to several thousand micrometers. Particularly suitable fiber diameters are in the range of 1 micrometer to about 5000 micrometers. The length of the fibers is often in the range of 1 millimeter to 100 meters.

In some embodiments of the polymeric fibers and the methods of making the polymeric fibers, at least a portion of the polar solvent can be removed from the first swollen polymeric fiber to form a dried fiber. The term "dried fiber" and "dried polymeric fiber" are used interchangeably herein. The dried fiber can then be contacted with a sorbate for a time sufficient for the dried fiber to sorb at least a portion of the sorbate. That is, a first swollen polymeric fiber can be dried to form a dried polymeric fiber that can then be contacted with a sorbate to form a second swollen polymeric fiber. The sorbate can contain at least one active agent. In addition to the active agent, the sorbate can include a fluid such as a liquid or a supercritical fluid. Some exemplary sorbates include an active agent plus a polar solvent.

As used herein, the term "sorb" refers to adsorb, absorb, or a combination thereof. Likewise, the term "sorption" refers to adsorption, absorption, or a combination thereof. The sorption can be a chemical process (i.e., a chemical reaction occurs), a physical process (i.e., no chemical reaction occurs), or both. The term "sorbate" refers to a composition that can be sorbed by polymeric fibers such as dried polymeric fibers.

More specifically, a method of making a polymeric fiber that includes an active agent is provided. The method includes forming a precursor composition containing (a) a polar solvent and (b) polymerizable material that is miscible with the polar solvent. The polymerizable material is capable of free-radical polymerization and has an average number of ethylenically unsaturated groups per monomer molecule greater than 1.0. The method further includes forming a stream of the precursor composition. The major axis (sides) of the stream is often surrounded by a gas phase. The stream is exposed to radiation for a time sufficient to at least partially polymerize the polymerizable material and to form a first swollen polymeric fiber. The method further includes removing at least a portion of the polar solvent from the first swollen polymeric fiber to form a dried fiber. The dried fiber is then contacted with a sorbate for a time sufficient for the dried fiber to sorb at least a portion of the sorbate and to form a second swollen polymeric fiber. The sorbate typically contains an active agent. The active agent can be a biologically active agent, a non-biologically active agent, or a mixture thereof.

This method often includes forming a precursor composition containing (a) 5 weight percent to 85 weight percent polar solvent based on a total weight of the precursor composition and (b) 15 weight percent to 95 weight percent polymerizable material based on the total weight of the precursor composition. The polymerizable material is miscible with the polar solvent. The polymerizable material is capable of free-radical polymerization and has an average number of ethylenically unsaturated groups per monomer molecule greater than 1.0. The polymerizable material includes a poly(alkylene oxide (meth)acrylate) having at least 2 (meth)acryloyl groups and having at least 5 alkylene oxide units. The method further includes forming a stream of the precursor composition. The major axis (sides) of the stream is often surrounded by a gas phase. The stream is exposed to radiation for a time sufficient to at least partially polymerize the polymerizable material and to form a first swollen polymeric fiber. The method further includes removing at least a portion of the polar solvent from the first swollen fiber to form a dried fiber. The dried fiber is then contacted with a sorbate for a time sufficient for the dried fiber to sorb at least a portion of the sorbate and to form a second swollen polymeric fiber. The sorbate typically contains an active agent. The active agent can be a biologically active agent, a non-biologically active agent, or a mixture thereof.

The amount of polar solvent removed from the first swollen polymeric fiber to form a dried fiber can be any amount desired. Often, at least 10 weight percent of the polar solvent is removed from the first swollen polymeric fiber to form a dried fiber. For example, at least 20 weight percent, at least 30 weight percent, at least 40 weight percent, at least 50 weight percent, at least 60 weight percent, at least 70 weight percent, at least 80 weight percent, at least 90 weight percent, or at least 95 weight percent of the polar solvent can be removed to form the dried fiber. The dried fiber often contains at least a small amount of polar solvent remaining in the polymeric material.

Additionally, if the dried fiber will be contacted with a sorbate to sorb an active agent into or onto the polymeric fibers, the amount of polar solvent present in the dried fiber is generally no more than 25 weight percent based on the weight of the dried polymeric fiber. The amount of polar solvent in the dried fiber can be less than 20 weight percent, less than 15 weight percent, less than 10 weight percent, less than 5 weight percent, less than 2 weight percent, or less than 1 weight percent of the weight of the dried polymeric fiber. Generally, the more solvent removed from the first swollen fiber, the greater is the amount of the sorbate that can be sorbed by the dried fiber.

The first swollen polymeric fiber shrinks when the polar solvent is removed and may resemble collapsed or deflated fibers having a cylindrical shape; some dried polymeric fibers may have an oval or elliptical cross-section. The cross-sectional shape of the dried polymeric fiber will depend on the cross-sectional shape of the first swollen polymeric fiber. The amount of shrinkage depends on the volume of polar solvent initially present in the first swollen polymeric fiber and the extent to which it is removed by drying.

Figure 5:
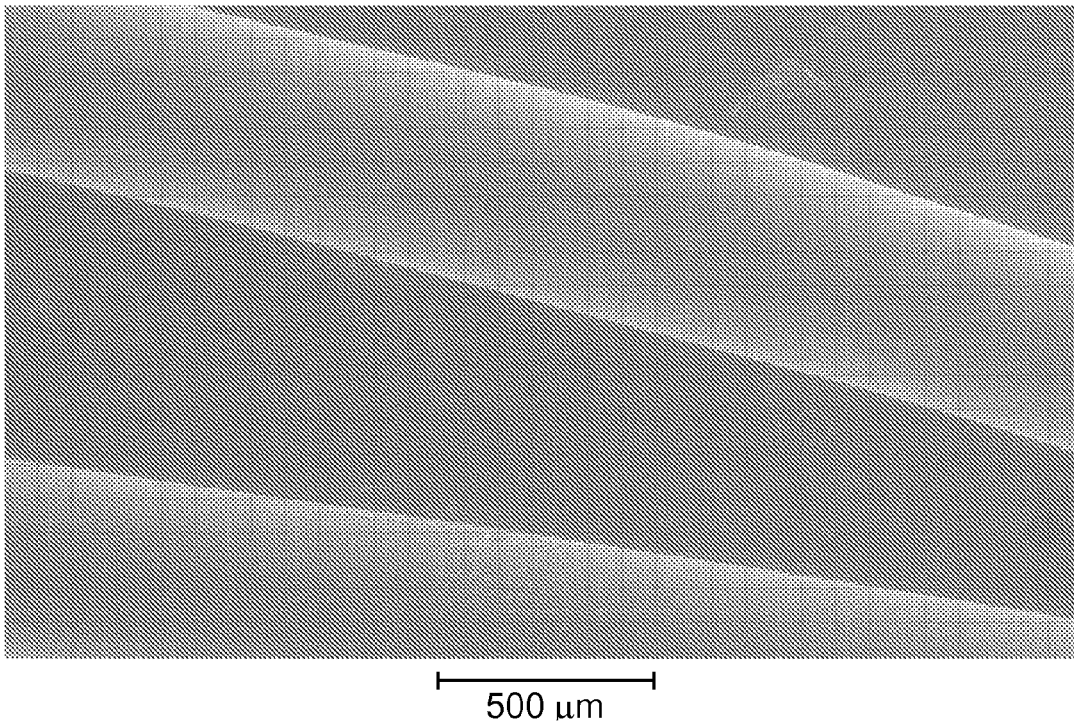
FIG. 5 is an exemplary environmental scanning electron micrograph of two dried polymeric fibers having a magnification of 50 times.

The dried polymeric fiber (particularly in the absence of an active agent) generally remains homogeneous and does not contain macroscopic (i.e., greater than 100 nm) internal pores or channels. Generally, the polymeric fibers have no discernible porosity or voids when viewed under a microscope. For example, there are no discernible pores when the polymeric fibers are viewed using environmental scanning electron microscopy with magnification up to 50 times as shown in FIG. 5 for two exemplary dried polymeric fibers. Some polymeric fibers have no discernible pores when viewed using field emission scanning electron microscopy with magnification up to 100 times, up to 200 times, up to 500 times, up to 1000 times, up to 2000 times, up to 5000 times, up to 10,000 times, up to 20,000 times, or up to 50,000 times. The dried fiber may have high modulus, high crush strength, or a combination thereof. These properties can be similar to or greater than those of the swollen polymeric fiber.

A swollen polymeric fiber can be dried (i.e., the swollen fiber can have at least a portion of the polar solvent removed) by any of a variety of methods including heating in a conventional oven such as a convection oven, heating in a microwave oven, air-drying, freeze-drying, or vacuum-drying. The optimal method for drying a given fiber composition is dependent on the identity and amount of the polar solvent present in the swollen polymeric fiber as well as the heat stability of components in the fiber such as bioactive agents. When water is present, preferred drying methods include conventional ovens such as convection ovens, microwave ovens, vacuum ovens, and freeze-drying. For water, suitable temperatures for drying at atmospheric pressure are often close to or exceeding 100° C. In some cases it may be desirable to heat the dried fiber to higher temperatures. This may improve fiber strength through condensation or other chemical reactions. For example, the fibers can be heated to greater than 140° C., greater than 160° C., or even greater than 180° C. The polymeric fibers do not coalesce when dried to form, for example, a film or sheet. Rather, the dried fibers tend to remain as separate particles.

The dried fiber can be readily swollen again, for example, by impregnating with a sorbate, back to its swollen state that can approximate the original size. Typically, the volume of sorbate that can be sorbed by the dried fiber to form a second swollen polymeric fiber is nearly equal to the volume of polar solvent and other non-polymerized components removed from the first swollen polymeric fiber during the drying process. In cases where the polar solvent present in the precursor composition and in the resulting first swollen fiber is different than the solvent in the sorbate used to swell the fiber a second time (e.g., swell a dried fiber), the dried polymeric fiber may swell very little or may swell beyond its original, as polymerized, dimensions.

Dried fibers can be loaded with an active agent, especially those that are sensitive to the heat or radiation encountered during the formation of the swollen polymeric fiber such as medicaments, pharmaceuticals, insecticides, herbicides, dyes, fragrances, or mixtures thereof. To provide a fiber with an active agent, the dried fiber is contacted with a sorbate that contains the active agent. If the active agent is not a liquid, the sorbate typically also contains a fluid such as a polar solvent or supercritical fluid (e.g., carbon dioxide). The sorbate can be a solution, suspension, or dispersion. In many embodiments, the sorbate is a solution. The dried fiber typically sorbs at least a portion of the sorbate. Exposure of the dried fiber to the sorbate results in the impregnation of the polymeric fiber with an active agent.

The sorbate often includes the active agent and a liquid such as a polar solvent. Sorption of the liquid often causes the polymeric fiber to swell. The liquid typically facilitates the transport of the active agent into the fiber. The liquid will often carry the active agent throughout the fiber to form a homogenous fiber. In some embodiments, however, the active agent may remain on the surface of the fiber or there may be a gradient of the active agent throughout the polymeric fiber with a higher concentration on the surface. For example, the size of the active agent (e.g., molecular size) as well as the polar solvent composition may affect the migration (e.g., diffusion) of the active agent into the dried fiber.

The dried polymeric fibers can often sorb an amount of sorbate that is equal to at least 10 weight percent, at least 20 weight percent, at least 40 weight percent, at least 50 weight percent, at least 60 weight percent, at least 80 weight percent, at least 100 weight percent, at least 120 weight percent, at least 140 weight percent, at least 160 weight percent, at least 180 weight percent, or at least 200 weight percent based on the weight of the dried polymeric fibers. The weight increase is typically less than 300 weight percent, less than 275 weight percent, or less than 250 weight percent based on the weight of the dried polymeric fibers.

The polymeric fiber can be a carrier for an active agent, which can be present in at least a portion of the interior of the fiber or on at least a portion of the surface of the fiber. The active agent can be included in the precursor composition used to form the polymeric fiber. Alternatively, the active agent can be sorbed by a polymeric fiber that has been at least partially dried. The polymeric fibers can provide diffusion-controlled transport both into and from the bulk. That is, in many embodiments, the active agent can diffuse into the polymeric fiber, diffuse out of the polymeric fiber, or both. The rate of diffusion should be controllable, for example, by varying the polymeric material and the crosslink density, by varying the polar solvent, by varying the solubility of the active agent in the polar solvent, by varying the molecular weight of the active agent, or a combination thereof. The diffusion can take place over a period of several hours, several days, several weeks, or several months.

In some applications, it may be desirable that the polymeric fiber containing the active agent is in a dry state. After the addition of the active agent by exposing the dried fiber to the sorbate to form a second swollen polymeric fiber that contains the active agent, the second swollen polymeric fiber can be dried again. When this second dried polymeric fiber is exposed to moisture, the active agent can diffuse from the polymeric fiber. The active agent can remain dormant in the second dried polymeric fiber until exposed to moisture. That is, the active agent can be stored within the second dried polymeric fiber until the fiber is exposed to moisture. This can prevent the waste or loss of the active agent when not needed and can improve the stability of many moisture sensitive active agents that may degrade by hydrolysis, oxidation, or other mechanisms. Potential applications taking advantage of the diffusion controlled uptake or delivery of the active agent include, for example, drug delivery, wound management, sustained-released antibacterial and antifungal protection, air freshening agents, time-released insecticides, and time-released attractants for higher animals such as fish or mammals.

As wound dressings, the polymeric fibers can be loaded with various active agents that provide a therapeutic function. Wound dressings containing these active agents may reduce or eliminate infection of the wound. In addition, these wound dressings can speed the rate of wound healing when therapeutic active agents such as anti-inflammatory drugs, growth factors, alpha-hydroxyacids, enzyme inhibitors such as matrix metalloproteinase (MMP) inhibitors, enzyme activators, vasodilaters, chemotactic agents, hemostatic agents (e.g., thrombin), antimicrobial agents, antihistamines, antitoxins, anesthetics, analgesics, vitamins, nutrients, or combinations are added to the polymeric fibers. When used in wound dressings, the polymeric fibers are typically dry prior to use in highly exuding wounds but may be used swollen to add moisture to dry wounds.

In some embodiments, the swollen polymeric fibers can be used to deliver antimicrobial agents to either mammalian tissue or another environment outside the polymeric fibers. Some exemplary antimicrobial agents that can be added to the polymeric fibers include iodine and its various complexed forms. Compounds that complex with iodine or triiodide are referred to as iodophors. Some iodophors are complexes of elemental iodine or triiodide with certain carriers. The swollen polymeric fibers and the dried polymeric fibers are iodophors. These iodophors function by not only increasing the iodine solubility but by reducing the level of free molecular iodine in solution and by providing a type of sustained release reservoir of iodine.

Iodine or complexes thereof can be supplied in a variety of forms to the polymeric fibers. For example, a solution of iodine and an iodine salt can be prepared that is sorbed by the dried polymeric fiber. Alternatively, iodine or complexes thereof can be supplied to the polymeric fibers using other iodophors. These other iodophor can be formed, for example, using polymeric carriers that contain iodine or iodine complexes. Suitable carriers include, for example, polyvinylpyrrolidone (PVP); copolymers of N-vinyl lactams with other unsaturated monomers such as, but not limited to, acrylates and acrylamides; various polyether glycols (PEGs) including polyether-containing surfactants such as nonylphenolethoxylates and the like; polyvinyl alcohols; polycarboxylic acids such as polyacrylic acid; polyacrylamides; and polysaccharides such as dextrose. Other suitable iodophors include the protonated amine oxide surfactant-triiodide complexes described in U.S. Pat. No. 4,597,975 (Woodward et al.). In some applications, the iodophor is povidone-iodine. This can be obtained commercially as povidone-iodine USP, which is a complex of K30 polyvinylpyrrolidone and iodide wherein the available iodine is present at about 9 weight percent to about 12 weight percent. When the polymeric fibers are exposed to one of these other iodophors, the iodine or complex thereof tends to partition between the polymeric fibers and the polymeric carrier used to deliver the iodine or complex thereof.

In some embodiments, various combinations of antimicrobial agents can be used in the precursor composition or sorbate. Any other known antimicrobial agents that are compatible with the precursor compositions or the resulting hydrogels can be used. These include, but are not limited to, chlorhexidine salts such as chlorhexidine gluconate (CHG), parachlorometaxylenol (PCMX), triclosan, hexachlorophene, fatty acid monoesters and monoethers of glycerin and propylene glycol such as glycerol monolaurate, glycerol monocaprylate, glycerol monocaprate, propylene glycol monolaurate, propylene glycol monocaprylate, propylene glycol moncaprate, phenols, surfactants and polymers that include a (C12-C22) hydrophobe and a quaternary ammonium group or a protonated tertiary amino group, quaternary amino-containing compounds such as quaternary silanes and polyquaternary amines such as polyhexamethylene biguanide, silver containing compounds such as silver metal, silver salts such as silver chloride, silver oxide and silver sulfadiazine, methyl parabens, ethyl parabens, propyl parabens, butyl parabens, octenidene, 2-bromo-2-nitropropane-1,3 diol, or mixtures thereof. Other antimicrobial agents are described, for example, in U.S. Patent Application Publications 2006/0052452 (Scholz), 2006/0051385 (Scholz), and 2006/0051384 (Scholz), all incorporated herein by reference.

Additionally, the polymeric fibers can be used to concentrate various materials such as contaminants or toxins. For example, the polymeric fibers can be used to remove contaminants from water systems or ecosystems. By incorporation of various functionalities into the polymeric material such as chelating agents, it may be possible to remove heavy metals, radioactive contaminants, and the like.

The fibers often contain unreacted ethylenically unsaturated groups. These ethylenically unsaturated groups can be reacted with other monomers, such as monomers in a coating composition. The fibers can be polymerized into the final coating. Further, some polymeric fibers have other functional groups that can be further reacted. For example, some of the poly(alkylene oxide (meth)acrylates) included in the precursor composition have hydroxy groups that can undergo various nucleophilic substitution reactions or condensation reactions.

Exemplary cosmetic and personal care applications, for which the fiber compositions may be used include, but are not limited to, wound care products such as absorbent wound dressings and wound packing to absorb excess exudates; first aid dressings, hot/cold packs, baby products, such as baby shampoos, lotions, powders and creams; bath preparations, such as bath oils, tablets and salts, bubble baths, bath fragrances and bath capsules; eye makeup preparations, such as eyebrow pencils, eyeliners, eye shadows, eye lotions, eye makeup removers and mascaras; fragrance preparations, such as colognes and toilet waters, powders and sachets; noncoloring hair preparations, such as hair conditioners, hair spray, hair straighteners, permanent waves, rinses, shampoos, tonics, dressings and other grooming aids; color cosmetics; hair coloring preparations such as hair dyes, hair tints, hair shampoos, hair color sprays, hair lighteners and hair bleaches; makeup preparations such as face powders, foundations, leg and body paints, lipsticks, makeup bases, rouges and makeup fixatives; manicuring preparations such as basecoats and undercoats, cuticle softeners, nail creams and lotions, nail extenders, nail polishes and enamels, and nail polish and enamel removers; oral hygiene products such as dentifrices and mouthwashes; personal cleanliness products, such as bath soaps and detergents, deodorants, douches and feminine hygiene products; shaving preparations such as aftershave lotions, beard softeners, men's talcum powders, shaving creams, shaving soap and pre-shave lotions; skin care preparations such as cleansing preparations, skin antiseptics, depilatories, face and neck cleansers, body and hand cleansers, foot powders and sprays, moisturizers, night preparations, paste masks, and skin fresheners; and suntan preparations such as suntan creams, gels and lotions, and indoor tanning preparations.

In some applications, the polymeric fiber contains an indicator that can detect the presence or absence of another compound of interest. The indicator can be added to the dried polymeric fibers using a sorbate that contains the indicator and an optional fluid such as a polar solvent (e.g., water, dimethylformamide, or the like). The fibers can be contacted with samples that potentially contain the compound to be detected. The indicator can then change color if the sample contains the compound to be detected. If the indicator does not migrate out of the fiber when exposed to the sample, the fiber may change color. If the indicator migrates out of the fiber when exposed to the sample, the sample itself may change color.

In a specific example, the polymeric fibers can be loaded with an indicator such as ninhydrin that is capable of detecting the presence of amino-containing materials. The dried polymeric fibers, which often are clear and colorless, can be loaded with ninhydrin to form a polymeric fiber that has a yellow color. A sorbate that contains the ninhydrin as well as a polar solvent can be used to add the active agent to the polymeric fiber. Upon contact of the ninhydrin-containing polymeric fiber with an amino-containing material, the ninhydrin changes from a yellow to vivid purple color. Depending on the relative rates of diffusion of the ninhydrin and the amino-containing materials, the fiber can change color from yellow to purple or the ninhydrin can migrate out of the fiber and alter the color of an amino-containing sample. For example, small amino-containing materials can diffuse into the ninhydrin-containing polymeric fibers and change the color of the fibers from yellow to purple. However, relatively large proteins cannot diffuse into the polymeric fibers as easily as the ninhydrin can migrate out of the fibers. The color of the sample containing the protein can change to a purple color while the fibers may not change to a purple color. In some other examples that contain a mixture of amino-containing materials, both the polymeric fibers and the amino-containing sample may change to a purple color.

Polymeric fibers loaded with dyes can be used as saturation indicators. The dye-containing polymeric fibers can be dried. When the dried fibers are contacted with water, the dye can diffuse out of the polymeric fiber and alter the color of the water. Alternatively, dyes can be incorporated that are colorless in the absence of water but turn colored when water is sorbed into the fiber. For example, certain pH indicators such as phenolphthalein are colorless when dry but will turn colored when wet.

The foregoing describes the invention in terms of embodiments foreseen by the inventors for which an enabling description was available, notwithstanding that insubstantial modifications of the invention, not presently foreseen, may nonetheless represent equivalents thereto.

EXAMPLES

The invention is further illustrated in the following illustrative examples, in which all parts and percentages are by weight unless otherwise indicated.

Zone of Inhibition Assay Method

Testing was performed by preparing separate solutions of *Staphylococcus aureus* (ATCC 6538), gram positive, and *Pseudomonas aeruginosa* (ATCC 9027), gram negative at a concentration of approximately $1\times10^8$ colony forming units (CFU) per milliliter (mL) in Phosphate Buffered Saline (PBS) from EMD Biosciences (Darmstadt, Germany) using a 0.5 McFarland Equivalence Turbidity Standard. This suspension was used to prepare a bacterial lawn by dipping a sterile cotton applicator into the solution and swabbing the dry surface of a trypticase soy agar (TSA) plate in three different directions. The TSA plate was obtained from Voigt Global Distribution, Inc. (Lawrence, Kans.). The fiber sample was cut to the desired length, which was typically 1.0±0.2 cm. Three fibers were placed on the inoculated plate and pressed firmly against the agar with sterile forceps to ensure complete contact with the agar. The plates are incubated at 28° C.±1° C. for 24 hours. The area under and surrounding the fiber was examined for bacterial growth and the diameter of the zone of inhibition was recorded.

*Candida albicans* testing: *Candida albicans* (ATCC 90028) was grown overnight in DIFCO Sabouraud dextrose (SD) broth available from Voigt Global Distribution, Inc. (Lawrence, Kans.). Cells were diluted to a concentration of approximately $1\times10^6$ colony forming units (CFU) per milliliter (mL) in Phosphate Buffered Saline (PBS) from EMD Biosciences (Darmstadt, Germany) using a 0.5 McFarland Equivalence Turbidity Standard. A fungal lawn was prepared by dipping a sterile cotton applicator into the cell suspension and swabbing the dry surface of a DIFCO SD agar plate in three different directions. The agar plate was obtained from Voigt Global Distribution, Inc. The fiber to be tested was first cut to the desired length, which was typically 10 to 18 mm. Three pieces were placed on an inoculated plate and pressed firmly against the agar with sterile forceps to ensure complete contact with the agar. The plates are incubated at 28±1° C. for 24 hours. The area under and surrounding the fibers was examined for fungal growth and the diameter of the zone of inhibition, in which fungal growth was reduced or completely eliminated, was recorded.

Example 1

Example 1 was made on equipment as illustrated in FIG. 2. Reference is made to the various elements of FIG. 2, the reference numerals indicated within parenthesis.

A homogeneous precursor composition was prepared that contained about 500 grams of 40 wt-% 20-mole ethoxylated trimethylolpropane triacrylate (TMPTA) (SR415 from Sartomer, Exeter, Pa.) and 1 weight percent photoinitiator (IRGACUR 2959 from Ciba Specialty Chemicals, Tarrytown, N.Y.) in deionized water. The weight percent of the triacrylate is based on the weight of the precursor composition and the weight percent of the photoinitiator is based on the weight of the polymerizable material. The precursor composition was placed in a reservoir (32), which was a pressure pot. The pot was pressurized to 30 psi. The delivery line from the pot included a 4-foot (123 cm) section of 0.25 inch (0.635 cm) polyethylene tubing (36) and a 3-foot (91 cm) section of 0.125 inch (0.3175 cm) stainless steel tubing (38) terminated in a Swagelok™ SS-200-R-1 fitting (34), which has an 800 micrometer (0.80 mm) internal diameter orifice, located approximately 2 inches (about 5 cm) above the upper end of the UV exposure zone.

From the Swagelok™ fitting, the path for the precursor composition was a 91 cm long, 5 cm diameter quartz tube (46) that extended through a UV exposure zone defined by a light shield (44) and a pair of 600 W/inch (240 W/cm) irradiators (42) (available from Fusion UV Systems, Gaithersburg, Md.) each equipped with a 25-cm long "H" bulb coupled to an integrated back reflector such that the bulb orientation was parallel to the falling liquid stream.

Once the pressurized stream was aligned so as to not contact the walls of the quartz tube, the flow was stopped, and a receiving vessel was placed below the quartz tube. The lamps were energized, the precursor stream was restarted, and fiber was collected in the receiving vessel.

The yield obtained was essentially the quantitative yield. The outer diameter of the fiber was approximately 500 micrometers, and the length of individual fibers ranged from several cm to at least 1 meter. The resulting fiber showed some elasticity.

Example 2

A strand of fiber prepared by the method of Example 1 was dried in an oven at 100° C. for two hours. The weight loss was approximately 60 weight percent. The dried fiber was placed in a solution of methylene blue in water. Within a few minutes, the fiber had sorbed a noticeable volume of solution and had become blue in color. After rinsing with DI water, a blue fiber was obtained.

Example 3

A small piece of the rinsed blue fiber from Example 2 was placed in a vial containing DI water. Within a few seconds, diffusion of blue from the fiber into the water was observed.

Examples 4-9

For these Examples, fibers were made in the same manner as Example 1, except that the Swagelok™ fitting at the terminus of the delivery line, the pressure in the pressure pot, and the stainless steel tubing (38) diameter were varied. The orifice diameter of each fitting and the properties of the resulting fibers are reported in Table 1.

TABLE 1

Effect of Orifice Diameter on Fiber Diameter

| Example | Fitting | Orifice ID, mm | Pressure, psi | Wet Fiber OD, μm | Dry Fiber OD, μm |
|---|---|---|---|---|---|
| 4 | SS-200-R-1 | 0.8 | 30 | 493 | 376 |
| 5 | SS-200-R-2 | 2.0 | 30 | 1107 | 739 |
| 6 | SS-200-R-3 | 3.0 | 30 | — | — |
| 7 | SS-400-R-2 | 2.0 | <5 | 1024 | 866 |
| 8 | SS-400-R-3 | 3.0 | <5 | 1712 | 1217 |
| 9 | SS-400-R-4 | 4.3 | <5 | — | — |

Both Examples 4 and 5 were good fibers. Example 6, with the 0.3175 cm diameter stainless delivery tube, was poor fiber, possibly because the constriction of the 0.3175 cm tube prevented sufficient supply of fiber precursor solution to the larger diameter orifice.

Examples 7 and 8 were made by replacing the stainless tubing with a larger, 0.635 cm stainless tube. The pot pressure was significantly reduced in order to decrease the stream exit velocity and provide adequate residence time in the UV region. The actual pressure during fiber formation was too low to be measured by the existing gauge on the pot, thus a value less than 5 psi is reported in Table 1. Examples 7 and 8 were good fibers that were formed at high flow rates on the order of about 2 to 4 kg/min. For Example 9, an orifice having an inner diameter of 4.3 mm was used, which is larger than the orifices used to prepare Example 7 (2.0 mm inner diameter) and Example 8 (3.0 mm inner diameter). The resulting fiber was a mixed solid/liquid, less polymerized than Examples 7 and 8, possibly due to the larger exit orifice diameter and the need for much higher flow rates.

The diameter of the polymeric fiber is usually about 50 to 80 percent of the orifice diameter. The diameter also depends on the viscosity of the polymerizable composition.

Examples 10-13

Examples 10-13 were prepared in the same manner as Examples 4, 5, 7 and 8 from above. The fibers were dried as in Example 2, and then swollen again with water. The properties of the fibers are reported in Table 2.

TABLE 2

| Ex. | Fitting | P, psi | Dry wt., g | Wet wt., g | Wt. gain | % change |
|---|---|---|---|---|---|---|
| 10 | SS-200-R-1 | 30 | 0.82493 | 2.92663 | 2.1017 | 255 |
| 11 | SS-200-R-2 | 30 | 0.37927 | 1.15845 | 0.77918 | 205 |
| 12 | SS-400-R-2 | <5 | 1.69547 | 5.42153 | 3.72606 | 220 |
| 13 | SS-400-R-3 | <5 | 0.89329 | 3.08474 | 2.19145 | 245 |

There was some visual indication that the larger diameter fibers (Examples 12 and 13) were not homogeneous and may have had some internal voids. These internal voids may possibly be due to air entrainment. With larger orifice diameters, higher flow rates can often minimize the formation of internal voids.

Example 14

A 7-cm long strand of fiber prepared using the method of Example 8 was dried for two hours at 100° C. Approximately 0.6 cm of the fiber was immersed in an aqueous solution of methylene blue in a glass vial. The rest of the fiber (about 6.5 cm) remained above the solution. The vial was capped and the vessel set aside. After 72 hours, the blue color migrated the entire length of the fiber and no solution was left in the vial.

Example 15

A 25:75 blend of a PEG 600 diacrylate (SR 610 from Sartomer) and 20-mole ethoxylated trimethylolpropane triacrylate (SR 415 from Sartomer) was prepared, to which was added 2 weight percent photoinitiator (IRGACURE 2959 from Ciba Specialty Chemicals). Approximately 500 grams of a 40 weight percent solution of the acrylate blend in water was placed in a pressure pot using the setup of FIG. 2. The solution was fed at a pressure between 20-30 psi through the equivalent of a SS-400-R-1 nozzle (0.80 mm inner diameter). Fiber was obtained having a diameter similar to that of the fiber from Example 1.

Example 16

The fiber reactor was set up as in Example 1 shown in FIG. 2 using the nozzle of Example 15 with an orifice inner diameter of 800 micrometers (0.8 mm). The pressure pot was filled with a precursor composition containing 40 weight percent 20-mole ethoxylated trimethylolpropane triacrylate (TMPTA) (SR415 from Sartomoer), 0.4 weight percent photoinitiator (IRGACURE 2959) and 59.6 weight percent water. The pressure pot was pressurized to 21 psi and the stream aligned. Once aligned, the pressure was released, the discharged precursor composition discarded and the collection vessel replaced with a clean one.

The flow of the precursor composition stream through the nozzle was again started at a pressure of 21 psi as the two Fusion LH-10 lamps equipped with mercury (H) bulbs were fired. Continuous fiber was collected in the collection vessel with no noticeable by-products. The fiber prepared was filtered in a Büchner funnel and washed three times with DI water.

Example 17

Hydrogel fiber was made as in Example 16 but using the equipment modifications shown in FIG. 3. Reference is made to the various elements of FIG. 3, the reference numerals indicated within parenthesis. The solution delivery system (130) consisted of a glass jar (132) to hold precursor composition (50) and a plastic tube immersed into the solution connected to the nozzle used in Example 16 stuck through a rubber stopper. The stopper was sized to provide a vacuum seal at the top of the quartz tube (146).

A 4-liter suction flask was used as the fiber collection vessel. A vacuum pump was used to provide vacuum and draw the precursor composition into the polymerization system (140) from the solution reservoir (132) (the glass jar). The pressure in the collection vessel was not measured. Water was drawn under vacuum through the system to align the nozzle and the collection flask so that there was no contact of the falling stream with either the sides of the quartz tube or the collection flask. At this point, the vacuum was broken using a bleed valve placed upstream from the pump and the glass jar (132) charged with the same precursor composition used in Example 16. The water used to align the system was left in the collection vessel.

Once the lamps were fired, the bleed valve was closed drawing the precursor composition into the polymerization system at a rate of approximately 200 g/min. Continuous fiber was collected in the collection vessel with no noticeable by-products. After consuming the precursor composition, the lamps were set to 'stand-by' and the bleed valve opened. The fiber and water mix were poured from the collection vessel into a large Büchner funnel and rinsed three times with distilled water. The resulting fiber showed excellent transparency as well as good elongation and tensile properties. The dimensions and tensile properties of fibers made using both the reduced pressure process of Example 17 and the fiber from Example 16 made using a positive pressure process were compared with the results summarized in Table 3.

TABLE 3

Comparison of Hydrogel Fiber Tensile Properties

| Sample | Diameter, mm | Max Stress, (Kpa) | Strain at Break (%) | Elastic Modulus, (Kpa) | Energy to Break, mJ |
|---|---|---|---|---|---|
| Ex. 16 - wet | 0.742 | 1059 | 38 | 3032 | 15.8 |
| Ex. 16 - dry | 0.523 | 1076 | 51 | 2409 | 9.9 |
| Ex. 17 - wet | 0.693 | 1496 | 41 | 4053 | 15.4 |
| Ex. 17 - dry | 0.488 | 1405 | 40 | 3896 | 7.2 |

Example 18

Fiber was made from a precursor composition that contained 90 weight percent 20-mole ethoxylated trimethylolpropane triacrylate, 1 weight percent IRGACURE 2959, and water using the process of Example 17. The fiber was flexible and elastic with a diameter comparable to the fiber diameter from Example 17, but with considerably more tensile strength. Upon drying, the fiber lost 10 weight percent of its mass and could be swollen again.

Example 19

A Bronopol solution was prepared by combining 1 part Bronopol (Trade designation MYACIDE AS PLUS), commercially available from BASF (Germany), with 5 parts IPA. Bronopol can function as an antimicrobial agent. The solution was agitated until well dissolved.

Fibers prepared as described in Example 1, were dried in 60° C. oven for one hour. The fibers had lengths of 1.0±0.2 cm. One part by weight dry fibers were soaked in 3 parts by weight Bronopol solution for 30 minutes within a glass jar. The fibers were removed from the solution, rinsed with DI water, and allowed to briefly dry on a paper towel. The fibers were evaluated for their antimicrobial performance using the zone of inhibition test method for *Staphylococcus aureus* (ATCC 6538) and *Pseudomonas aeruginosa* (ATCC 9027). The resulting zones of inhibition were irregular in shape. The measured zone was roughly 35 mm for *Staphylococcus aureus*, and 30 mm for *Pseudomonas aeruginosa.*

Example 20

Fibers were prepared as described in Example 1. The fibers were dried for 1.5 hours at 70° C. before contacting a povidone iodine solution.

A povidone iodine solution was prepared by combining 10 parts by weight povidone iodine with 90 parts by weight water. Povidone iodine, which is a 1-ethyenyl-2-pyrrolidone homopolymer compound with iodine, is available from the Prudue Frederick Company (Stamford, Conn.) under the trade designation BETADINE or from Sigma-Aldrich (Saint Louis, Mo.). Povidone iodine can be used as an antiseptic.

0.2 parts dried fibers were placed in a glass jar along with two parts of the povidone iodine solution. The fibers were allowed to adsorb the solution for 2 hours at room temperature, turning red in color. Afterwards, the fibers were removed from solution, rinsed with DI water, and air dried. Samples were then transferred to a clean glass vial and capped. The treated fibers were evaluated against *Candida albicans* using the zone of inhibition method. For a fiber that was 10 mm long, the zone of inhibition was 14 mm perpendicular to the fiber length.

Example 21

Fibers were prepared as described in Example 1. The fibers were dried for 1.5 hours at 70° C. before contacting a miconazole solution.

A saturated solution of miconazole was prepared by adding approximately 1 part miconazole nitrate to 99 parts water. The miconazole nitrate, which is 1-[2-(2,4-dichlorophenyl)-2-[(2,4-dichlorophenyl)methoxy]ethyl]imidazole, can be used as an antifungal agent and can be obtained from Sigma-Aldrich Chemical Co., Saint Louis, Mo. After 3 days of gentle rocking, excess undissolved miconazole was removed by centrifuging the solution for 15 minutes at 2900 time the force of gravity. The supernatant was then passed through a 0.22 micron syringe filter, which is commercially available from Whatman (Middlesex, UK).

0.1 parts dried fibers was placed in a glass jar along with two parts of miconazole solution. The fibers were allowed to absorb the solution for 2 hours at room temperature. Afterwards, the fibers were removed from solution, rinsed with DI water, and air dried. Samples were then transferred to a clean glass vial and capped. The treated fibers were evaluated against *Candida albicans* using the zone of inhibition method. For a fiber that was 18 mm long, the zone was 23 mm perpendicular to the fiber length.

Example 22

Fibers were prepared as described in Example 1. The fibers were dried for 1.5 hours at 70° C. before contacting a econazole solution.

A saturated solution of econazole was prepared by adding approximately 1 part econazole nitrate to 99 parts water. Econazole, which is 1-[2-[(4-chlorophenyl)methoxy]-2-(2,4-dichlorophenyl)-ethyl]imidazole, can be used as an antifungal agent and is commercially available from Sigma-Aldrich Chemical Co., Saint Louis, Mo. After 3 days of gentle rocking, excess undissolved econazole was removed by centrifuging the solution for 15 minutes at 2900 times the force of gravity. The supernatant was then passed through a 0.22 micron syringe filter, which is commercially available from Whatman (Middlesex, UK).

0.1 parts dried fibers was placed in a glass jar along with two parts of econazole solution. The fibers were allowed to absorb the solution for 2 hours at room temperature. Afterwards, the fibers were removed from solution, rinsed with DI water, and air dried. Samples were then transferred to a clean glass vial and capped. The treated fibers were evaluated against *Candida albicans* using the zone of inhibition method. For a fiber that was 18 mm long, the zone of inhibition was 29 mm perpendicular to the fiber length.

Example 23

Treated fibers from Example 21 and 22 were examined for time-dependent active release. After the zone of inhibition against *Candida albicans* was measured for the fibers, the same fibers were transferred to a freshly inoculated agar plates and incubated for 24 hours. After the second 24-hour incubation, the zone of inhibition was measured again as the day 2 zone, and the fibers were transferred again to a new plate. This process was repeated on a daily basis for one week or until no zone was detected. The zones persisted for 7 days for fibers treated with miconazole and econazole.

Example 24

Fibers were prepared as described in Example 1. The fibers were dried in 60° C. oven for 2 hours. Two different size fibers were used. The first fiber had initial weight of 0.18 grams and length of 6.2 cm. After drying, the first fiber weight was 0.05 grams with length of 4.2 cm. The second fiber had initial weight of 0.02 grams and length of 10 cm. After drying, the second fiber weight was 0.012 grams with length of 7 cm.

Phthalein dye solution was prepared by combining 8 parts water, 5 parts sodium hydroxide solution (5 weight percent in water), and 0.04 parts o-Cresolphthalein dye from Kodak. The solution color was deep purple. The phthalein pH indicator dye solution was added to the dried fibers and allowed to absorb for 2 hours. The fibers were removed from solution and rinsed with DI water. The fibers were vivid purple in color.

The colored fibers were dried in 60 C oven for 2.5 hours. The purple color disappeared, and the fibers appeared completely transparent. When DI water was added to the dried fibers, the purple color returned within 5 seconds. After 1 minute, the purple color began to leach out of the fibers into the surrounding water.

Example 25

Fibers were prepared as described in Example 1. The fibers were dried in a 80° C. oven for 2 hours. The dehydrated fibers (0.35 g) were reacted with 1 weight percent ninhydrin aqueous solution (4 mL) at room temperature for 24 hours. Ninhydrin is available from Aldrich Chemical Co. (Milwaukee, Wis.). After being exposed to the ninhydrin aqueous solution, the fibers were rinsed with water and ethanol, and dried in air for 4 hours. The dried ninhydrin-containing fibers were kept in closed vials for future use.

A first sample of the ninhydrin-containing fibers was contacted with a 5 weight percent aqueous solution of buminate albumin and a second sample of the ninhydrin-containing fibers was contacted with a pork juice solution. The buminate albumin (25 weight percent solution) was obtained from Baxter Healthcare Co. The pork juice solution was prepared by extracting about 16 gram of fresh pork chop meat with 20 mL of water for 16 hours; the resulting mixture was filtered. The total protein in the meat juice was measured according to Pierce assay and ranged from approximately 17 mg/mL to 37 mg/mL.

For exposure to these two samples, 100 mg of the ninhydrin-containing fibers were placed in two separate vials (4 mL). Then, 750 μL of the pork juices was added to the first vial and 750 μL of the 5 weight percent buminate albumin protein aqueous solution was added to the second vial. In about 30 minutes, both vials started to turn blue, and eventually turn purple. In the vial with pork juice, the fibers turn purple. The pork juice didn't change the color. However, in the vial with buminate albumin, the solution turned purple while the fibers showed no purple color.

Example 26

A silver oxide-containing solution was prepared by combining 5 parts by weight ammonium carbonate, commercially available from Sigma-Aldrich Chemical Company (St. Louis, Mo.), with 95 parts by weight water and mixing until the salt was dissolved. One part by weight silver oxide (AgO), commercially available from Alfa Aesar (Ward Hill, Mass.), was added to this solution. The mixture was stirred at 60° C. for one hour until the silver oxide was dissolved resulting in a clear transparent solution containing silver ions.

Fibers prepared as described in Example 1, were dried in 60° C. oven for one hour. One part by weight of the dried fibers was placed in a glass jar along with 3 parts by weight of the silver oxide solution for one hour. The fibers turned dark gray in color. After that, the fibers were filtered out of solution, rinsed with DI water, briefly dried on a paper towel, and then transferred to a clean glass vial and capped. The fibers treated with silver oxide were evaluated using the zone of inhibition assay method. The diameter of the zone of inhibition against *Staphylococcus aureus* was 1 mm and the diameter of the zone of inhibition against *Pseudomonas aeruginosa* was 5 mm.

Example 27

Fibers were prepared according to the method described in Example 1. The resulting fiber was then dried in an oven at 70° C. for 30 hours. There was a 55 percent weight loss upon drying. A 400 mg sample of this dried fiber was then placed in a vial containing 10 mL of a solution of 100 mM elemental iodine in 200 mM potassium iodide. This solution was a deep bluish black color. The vial containing the fiber sample and the iodine solution was gently rocked for several hours. The liquid phase became clear while the fiber turned a bluish black indicating that the fiber had actively taken up the iodine. Then 2 mL aliquots of the iodine/iodide solution were added and the vial rocked between each addition until the liquid phase changed from bluish black to clear. Addition of these aliquots was continued until the liquid phase remained a light brownish red color. This happened after the 400 mg of dried fiber was exposed to a total of 26 mL of the iodine/iodide solution.

The iodine saturated fiber was then tested for antimicrobial activity using the zone of inhibition test described earlier. A zone of inhibition was seen around the iodine saturated fiber for both *Staphylococcus aureus* and *Pseudomonas aeruginosa* although the zone was larger for *Staphylococcus aureus* (1 to 2.5 cm) than for *Pseudomonas aeruginosa* (0.5 to 1 cm).

We claim:

1. A method of making a polymeric fiber, the method comprising:

providing a precursor composition comprising:

a) at least 5 weight percent polar solvent based on a total weight of the precursor composition, wherein the polar solvent comprises water and is not reactive in the precursor composition; and b) polymerizable material capable of free-radical polymerization and having an average number of ethylenically unsaturated groups per monomer molecule greater than 1.0, wherein the polymerizable material is miscible with the polar solvent;

forming a stream of the precursor composition; and exposing the stream to radiation for a time sufficient to at least partially polymerize the polymerizable material and to form a first swollen polymeric fiber having an aspect ratio greater than 3:1, wherein the first swollen polymeric fiber is a hydrogel swollen with the polar solvent.

2. The method of claim 1, wherein the polymerizable material comprises a poly(alkylene oxide (meth)acrylate) having an average number of (meth)acryloyl groups per monomer molecule equal to at least 2.

3. The method of claim 2, wherein the poly(alkylene oxide (meth)acrylate) has a weight average molecular weight no greater than 2000 g/mole.

4. The method of claim 1, wherein the method further comprises removing at least a portion of the polar solvent from the first swollen fiber to form a dried fiber.

5. The method of claim 1, wherein the precursor composition further comprises an active agent.

6. The method of claim 5, wherein the active agent comprises a bioactive agent.

7. The method of claim 1, wherein the precursor composition further comprises a photoinitiator and the radiation comprises actinic radiation.

8. The method of claim 1, wherein the method further comprises removing at least a portion of the polar solvent from the first swollen fiber to form a dried fiber; and contacting the dried fiber with a sorbate for a time sufficient for the dried fiber to sorb at least a portion of the sorbate to form a second swollen polymeric fiber, wherein the sorbate comprises at least one active agent.

9. The method of claim 8, wherein the method further comprises drying the second swollen polymeric fiber.

10. A method of preparing an article comprising a polymeric fiber, the method comprising:

providing a precursor composition comprising a) 5 weight percent to 85 weight percent polar solvent based on a total weight of the precursor composition, wherein the polar solvent comprises water is not reactive in the precursor composition; and b) 15 weight percent to 95 weight percent polymerizable material based on the total weight of the precursor composition, the polymerizable material being capable of free-radical polymerization and being miscible in the polar solvent, the polymerizable material comprising a poly(alkylene oxide (meth)acrylate) having at least 2 (meth)acryloyl functionality groups and having at least 5 alkylene oxide units; and forming a stream of the precursor composition; and exposing the stream to radiation for a time sufficient to at least partially polymerize the polymerizable material and to form a first swollen fiber having an aspect ratio greater than 3:1, wherein the first swollen fiber is a hydrogel swollen with the polar solvent.

11. The method of claim 10, wherein the method further comprises removing at least a portion of the polar solvent from the first swollen fiber to form a dried fiber.

12. The method of claim 10, wherein the precursor composition comprises less than 1 weight percent anionic monomer based on the weight of the polymerizable material.

13. The method of claim 10, wherein the poly(alkylene oxide (meth)acrylate) has a weight average molecular weight less than 2000 g/mole.

14. The method of claim 10, wherein the precursor composition further comprises an active agent.

15. The method of claim 14, wherein the active agent comprises a bioactive agent.

16. The method of claim 10, wherein the precursor composition further comprises a photoinitiator and the radiation comprises actinic radiation.

17. The method of claim 10, wherein the method further comprises removing at least a portion of the polar solvent from the first swollen fiber to form a dried fiber; and contacting the dried fiber with a sorbate for a time sufficient for the dried fiber to sorb at least a portion of the sorbate to form a second swollen polymeric fiber, wherein the sorbate comprises an active agent.

18. The method of claim 17, wherein the active agent comprises an ethylenically unsaturated group and a photoinitiator, the method further comprises exposing the second swollen polymeric fiber to actinic radiation.

19. The method of claim 17, wherein the method further comprises drying the second swollen polymeric fiber.

20. An article comprising a polymeric fiber having an aspect ratio greater than 3:1, the polymeric fiber comprising a free-radical polymerization reaction product of a precursor composition comprising a) 5 weight percent to 85 weight percent polar solvent based on a total weight of the precursor composition, wherein the polar solvent comprises water and is not reactive in the precursor composition; and b) 15 weight percent to 95 weight percent polymerizable material based on the total weight of the precursor composition, the polymerizable material being capable of free-radical polymerization and being miscible in the polar solvent, the polymerizable material comprising a poly(alkylene oxide (meth)acrylate) having at least 2 (meth)acryloyl groups and having at least 5 alkylene oxide units, wherein the polymeric fiber is a hydrogel or a dried hydrogel.

21. An article comprising a polymeric fiber having an aspect ratio greater than 3:1, the polymeric fiber comprising:

a) a free-radical polymerization reaction product of a precursor composition comprising polymerizable material being capable of free-radical polymerization, the polymerizable material comprising a poly(alkylene oxide (meth)acrylate) having at least 2 (meth)acryloyl groups and having at least 5 alkylene oxide units; and b) an active agent.

22. The method of claim 1, wherein the polymerizable material comprises an alkoxylated di(meth)acrylate, alkoxylated tri(meth)acrylate, alkoxylated tetra(meth)acrylate, or alkoxylated penta(meth)acrylate.

23. The method of claim 10, wherein the polymerizable material comprises an alkoxylated di(meth)acrylate, alkoxylated tri(meth)acrylate, alkoxylated tetra(meth)acrylate, or alkoxylated penta(meth)acrylate.

24. The article of claim 20, wherein the polymerizable material comprises an alkoxylated di(meth)acrylate, alkoxylated tri(meth)acrylate, alkoxylated tetra(meth)acrylate, or alkoxylated penta(meth)acrylate.

* * * * *